US010631664B2

(12) United States Patent
Kee et al.

(10) Patent No.: US 10,631,664 B2
(45) Date of Patent: Apr. 28, 2020

(54) TWO-PIECE BABY CARRIER

(71) Applicant: MI BRANDS, LLC, Los Angeles, CA (US)

(72) Inventors: Neil Kee, Pasadena, CA (US); Scott Thomason, Aurora, OH (US)

(73) Assignee: MI BRANDS, LLC, Los Angeles, CA (US)

( * ) Notice: Subject to any disclaimer, the term of this patent is extended or adjusted under 35 U.S.C. 154(b) by 0 days.

(21) Appl. No.: 16/248,143

(22) Filed: Jan. 15, 2019

(65) Prior Publication Data

US 2019/0216232 A1 Jul. 18, 2019

Related U.S. Application Data

(60) Provisional application No. 62/617,677, filed on Jan. 16, 2018.

(51) Int. Cl.
*A47D 13/02* (2006.01)
*A47D 15/00* (2006.01)

(52) U.S. Cl.
CPC ..... *A47D 13/025* (2013.01); *A47D 15/005* (2013.01)

(58) Field of Classification Search
CPC ..... A47D 13/02; A47D 13/025; A44B 11/266
USPC ..... 224/158–160
See application file for complete search history.

(56) References Cited

U.S. PATENT DOCUMENTS 3,481,517 A * 12/1969 Aukerman ..... A47D 13/025 224/160
5,678,739 A * 10/1997 Darling ..... A47D 13/025 224/158
6,931,695 B2 * 8/2005 Anscher ..... A44B 11/2549 24/614
7,484,645 B2 * 2/2009 Hoff ..... A47D 13/025 224/159
8,196,273 B2 * 6/2012 Anscher ..... A44B 11/266 24/265 BC
8,522,410 B2 * 9/2013 Parisi ..... A44B 11/2546 24/606
2009/0302075 A1 * 12/2009 Trainer ..... A47D 13/025 224/160
2012/0297527 A1 * 11/2012 Darnell ..... F41H 1/02 2/455
2014/0284361 A1 * 9/2014 Wang ..... A47D 13/025 224/159

(Continued)

OTHER PUBLICATIONS

Morph Baby Carrier—Black Jack by Mamas & Papas, https://www.mamasandpapas.com/en-gb/morph-baby-carrier-black-jack/p/217520704/, dated Dec. 18, 2017 (9 pages).

*Primary Examiner* — Adam J Waggenspack

(74) *Attorney, Agent, or Firm* — Crowe & Dunlevy; Andre M. Szuwalski

(57) ABSTRACT

A baby carrying system includes two discrete carrier pieces: a baby support piece which secures the baby and a harness piece worn by the parent. The baby support piece can be attached to the harness piece using a latching mechanism. Further secured attachment to support positioning of the baby support piece relative to the harness piece is achieved using fastening connection points at the middle and top of an upper support portion of the baby support piece. Straps with buckle connections extend from the harness piece, to enable to the buckle connections to engage with the fastening connection points.

26 Claims, 19 Drawing Sheets

(56) References Cited

U.S. PATENT DOCUMENTS

| | | | | |
|---|---|---|---|---|
| 2017/0119173 | A1 | 5/2017 | Telford | |
| 2018/0055245 | A1* | 3/2018 | Foged | A47D 13/025 |

* cited by examiner

TWO-PIECE BABY CARRIER

CROSS REFERENCE TO RELATED APPLICATION

This application claims priority to U.S. Provisional Application for Patent No. 62/617,677 filed Jan. 16, 2018, the disclosure of which is incorporated by reference.

TECHNICAL FIELD

The present invention relates to a soft structured baby carrier.

BACKGROUND

A soft structured baby carrier is a type of baby carrier that does not utilize a framed internal structure. This type of baby carrier has become more popular as a way for a parent to carry the child in a position that is close to the body while still leaving both hands free. Such a baby carrier is a useful product for a parent to use while walking, shopping, running errands, performing household chores, traveling and the like.

The current form of design for a soft structured baby carrier is typically a one-piece product made of soft good fabrics and similar non-structured foams. Typically, the baby carrier includes a cradle part that supports the child when sitting in the carrier. The lower portion of the cradle part is usually affixed to the top of a padded fabric waist part that is configured to wrap around the waist of the parent. The waist part usually includes a snap buckle with adjustable straps, with the parent operating the snap buckle at their side or back when fastening the waist part. Connected to an upper portion of the cradle part are two padded shoulder straps that wrap around the top and back of the shoulders of the parent. The shoulder straps then transition into adjustable webbing straps which pass under the armpit of the parent for connection to a middle portion of the cradle part. The parent can adjust the size and tightness of the openings formed by the shoulder straps by pulling on the adjustable webbing straps. Also included is an adjustable back lateral strap with a standard release buckle, the back lateral strap being configured to connect the shoulder straps together and prevent the shoulder straps from falling off the shoulders of the parent. The cradle part of the baby carrier usually extends vertically into the upper support portion so as to cover up to or beyond the head of the child (depending, of course, on child height). The baby carrier will typically require, for purchase at an additional cost, an insert that supports and props up the child while they are newborn and/or an infant so that the child will sit at a proper seating height.

It is common for the conventional soft structured baby carrier to support the child in three different seating positions: (1) a front carry position with the baby facing inward toward the chest of the parent, (2) a front carry position with the baby facing outward away from the chest of the parent, and (3) a back carry position with the baby facing toward the back of the parent. In the front carry position case where the baby is facing inward toward the chest of the parent, it is common for the upper support portion to extend above the head of the baby in order to keep the baby's head from falling backwards (this being more of a concern for infants than for toddlers). In the front carry position case where the baby is facing outward away from the chest of the parent, it is common for the upper support portion to be folded down, out of the way, so that it does not cover the face of the baby.

Given that the shoulder straps connect to the top and middle portion of the cradle part, the adjustable straps keep the cradle portion and the baby from falling away from the parent.

While the current one piece product designs provide satisfactory support for the baby in a number of different carry positions, it is a requirement for the parent to either engage or remove the entire system (i.e., release buckles and remove arms from the should strap openings) in order to effectively use the baby carrier product. This is especially bothersome in the frequent cases where the needs of the baby, such as for naps, feeding, changing diapers, and the like, must be addressed.

An additional drawback of current one piece product designs is a requirement to purchase and configure additional components in order for the baby carrier to be fully-functional over a wide range of baby ages from newborn to toddler. Alternatively, new baby carriers must be purchased as the baby grows. In either case, this adds a monetary expense that many parents would certainly like to avoid.

Another drawback of current baby carrier designs is a lack of sufficient airflow and breathability with respect to the fabric and support that is adjacent the body of the baby.

SUMMARY

In an embodiment, a baby carrier system comprises: a parent component in the form of a harness piece configured to be worn by a parent; a baby component in the form of a baby support piece configured to support a baby; wherein the harness piece includes a first connector of a male-female connector system and the baby support piece includes a second connector of the male-female connector system, said male-female connector system permitting the baby support piece to be mounted to the harness piece; said second connector including a release ring (or loop strap) that is configured to be grabbed by a first arm of the parent to support the baby support piece (for example, during both mounting the baby support piece to the harness piece and dismounting the baby support piece from the harness piece).

In an embodiment, the baby component can be further secured to the parent component by fastening connection points to the middle and top of an upper support portion of the baby component.

The parent may elect to put on the parent component on first followed by securing an empty baby component to the parent component through engagement of the male-female connector system. Then the baby may be loaded into the empty baby component and the baby component further secured to the parent component using an adjustable strap and buckle system.

The parent can put on the parent component by wrapping a waist portion around and securing a fastening buckle behind the parent and putting their arms through shoulder straps (which may be further secured using a back lateral strap). With the baby secured in the baby component and the parent component secured to the parent, the parent simply lifts the baby in the baby component and slides the male connector element of the baby component into the mating female connector element on the waist portion of the parent component. In connection with this operation, a release ring part of the male connector element may be grasped by one hand of the parent while the other hand of the parent supports the back of the baby component. Then, the parent can use adjustable straps with buckle pieces at each end for attachment to mating stud pieces fixed at the middle and top of the upper support portion of the baby component. These final connection points will keep the baby from falling away from the parent.

Alternatively, the parent can put on the parent component as described above and also secure an empty baby component by sliding the male connector element of the baby component into the mating female connector element on the waist portion. With the baby component and the parent component secured to the parent, the parent simply lifts the baby and places them in the cradle portion of the baby component and then securely fastens each of the adjustable straps with buckle pieces at each end to the corresponding mating stud pieces that are fixed at the middle and top of the upper support portion of the baby component. Again, these final two connections keep the baby from falling away from the parent.

An advantage of the system is that the parent can continue to wear the parent component while the baby component has been disengaged. A benefit of this is that the adjustment of the fitting of the parent component to the body of the parent need not be disturbed in order to permit attention to the needs of the baby with the baby component disengaged.

BRIEF DESCRIPTION OF THE DRAWINGS

The accompanying drawings are included to provide a further understanding of the invention and are incorporated in and constitute a part of this specification, illustrate embodiments of the invention and together with the description serve to explain the principles of the invention.

In the drawings.

DETAILED DESCRIPTION

The present invention concerns a baby carrier system formed of two pieces. The first piece is a harness piece that is worn by the parent. The second piece is a baby support piece within which the baby is supported. The second piece is mounted to the first piece using a connector system having a female connection part mounted to one of the first or second pieces and a male connection part that is mounted to the other of the first or second pieces. In a preferred implementation, the female connection part is mounted to the harness piece and the male connection part is mounted to the baby support piece. The male connection part is received by female connection part. A latching system is provided to retain the male connection part within the female connection part. The latching system may be selectively actuated by the parent to disconnect the male connection part from the female connection part and thus permit second piece to be disconnected from the first piece in a configuration where the baby remains supported by the second piece and the first piece continues to be worn by the parent.

Figure 1:
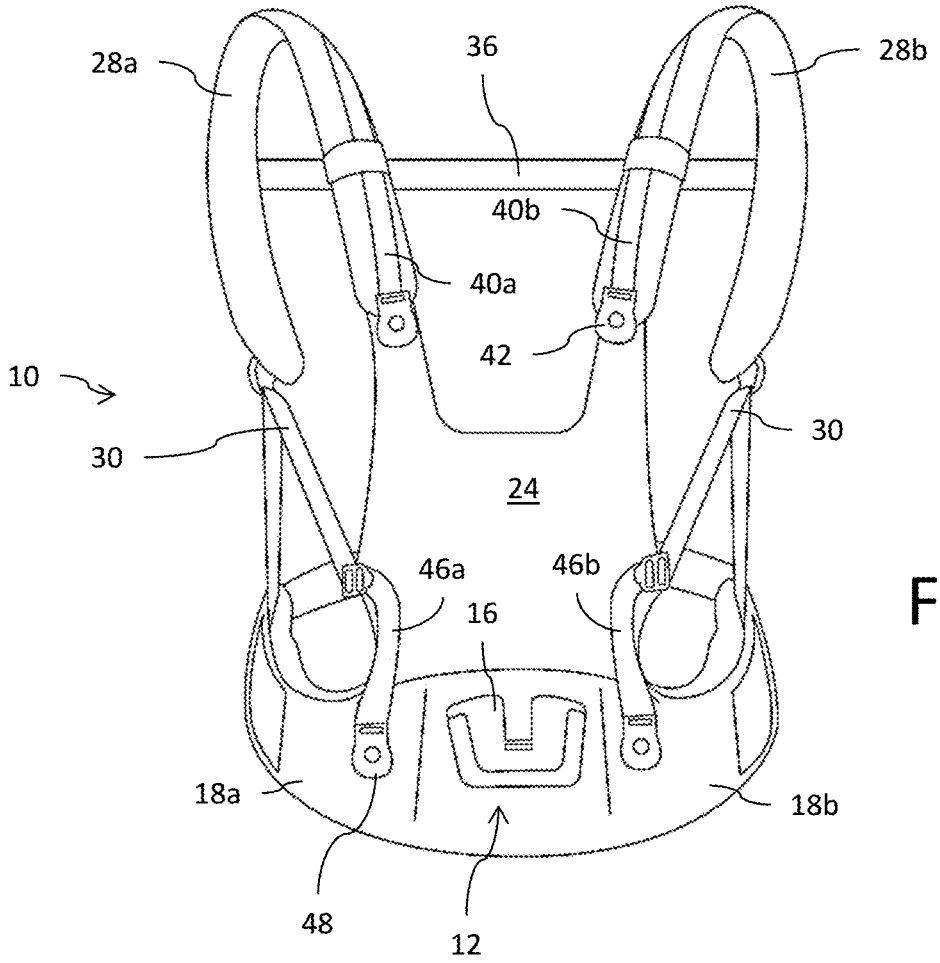
FIGS. 1-3 show views of a harness piece.
Figure 2:
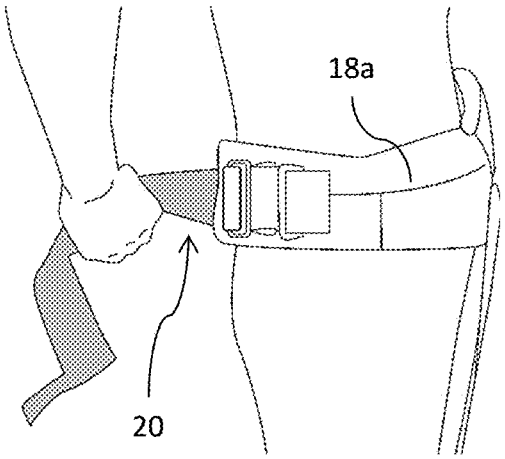
Figure 3:
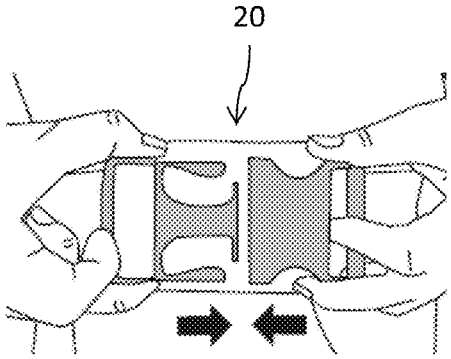

FIG. 1 shows a front view of the first piece comprising a harness piece 10. The harness piece 10 includes a waist portion 12 having a front surface and a rear surface, with the rear surface facing the body of the parent (either their chest or back, depending on front or back carry position, respectively). The waist portion 12 is made of a structurally reinforced material, such as an engineering plastic, with a foam and fabric covering. A female connection part 16 is mounted to and supported by the waist portion in an exposed condition at the front surface. Laterally extending from the sides of the waist portion 12 are a first waist belt portion 18*a* and a second waist belt portion 18*b*. The waist belt portions 18 are made of fabric covered foam and distally terminate at ends which may be connected to each other by an adjustable strap and buckle system 20 as shown in FIGS. 2 and 3 that fastens around to secure the harness piece 10 to the waist of the parent. Strap adjustment as shown in FIG. 2 permits the parent to easily adjust the tightness with which the waist portion 12, first waist belt portion 18*a* and second waist belt portion 18*b* are secured to the body of the parent. Additionally, this adjustable securing allows the parent to choose the positioning of the waist portion 12, first waist belt portion 18*a* and second waist belt portion 18*b* relative to the body of the parent and thus support mounting at the waist or hips as is desired.

Figure 4:
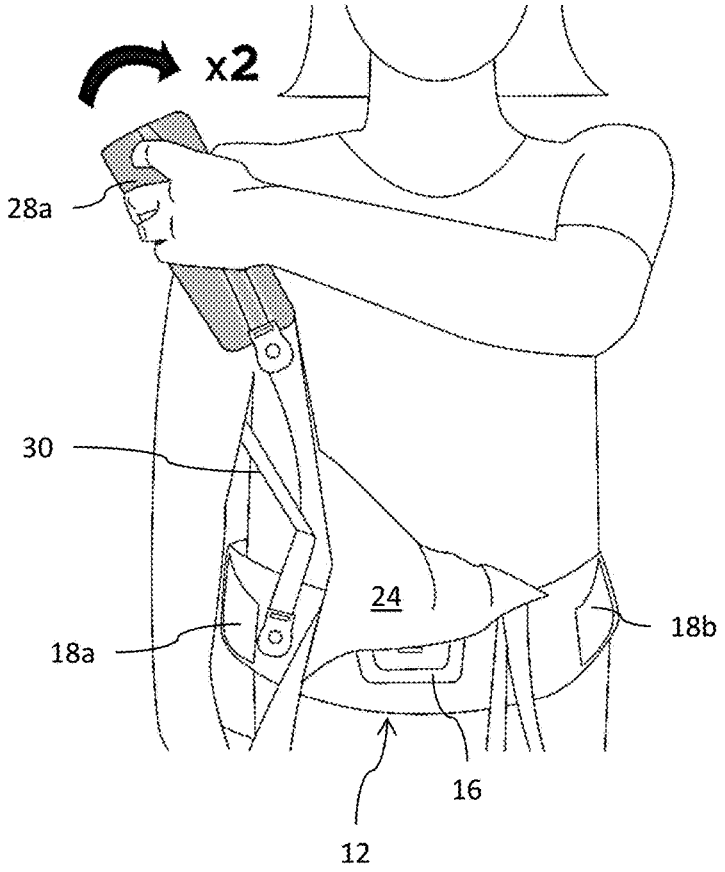
FIGS. 4-5 show installation of the harness piece on a parent.
Figure 5:
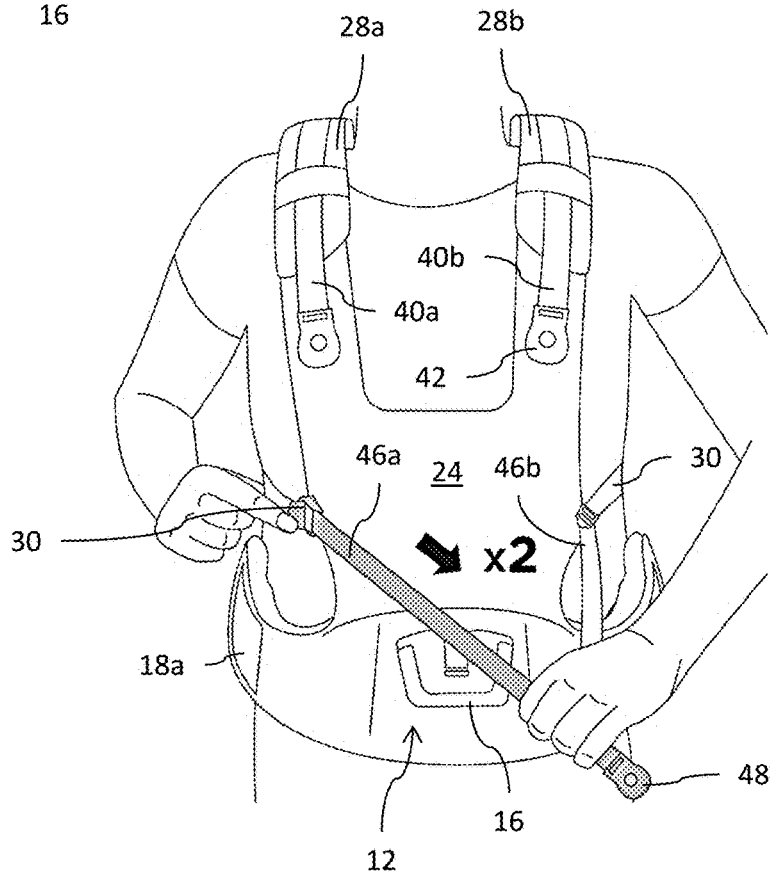

The harness piece 10 further includes a front panel portion 24 that is connected at its bottom to the top of the waist portion 12. The front panel portion 24 is preferably made of a fabric material. Two adjustable shoulder straps 28*a* and 28*b* are connected at their first (or proximate) ends, respectively, to the top of the front panel. The adjustable shoulder straps 28 are made of fabric covered foam and distally terminate at second (or distal) ends, respectively, which may be connected to sides of the front panel by an adjustable strap and buckle system 30 that defines arm openings. FIG. 4 shows that the waist portion 12, first waist belt portion 18*a* and second waist belt portion 18*b* have first been secured (but perhaps not yet tightened) around the body of the parent and then the arms of the parent are passed, for example, one at a time, through the arm openings formed by the shoulder straps 28 and adjustable strap and buckle system 30. A first strap end of the strap and buckle system 30 is secured through a buckle to the distal end of the shoulder strap. A second strap end the strap and buckle system 30 is secured through a buckle to the side of the front panel. The strap and buckle system 30 is tightened by pulling on either loose end (for example, as shown in FIG. 5). Advantageously, the size of the arm opening can be adjusted in two points with respect to the strap and buckle system 30 to allow for loosening or tightening as needed for comfort and security. This is particularly advantageous when using the baby carrier in the different carrying positions disclosed herein, thus allowing the parent to choose the easiest adjustment point to tighten or loosen the arm openings. The first adjustment point is affixed to the distal end of the shoulder strap. The second adjustment point is affixed to the side edge of the front panel portion 24 and operates with respect to the second strap end of the strap and buckle system 30 (with adjustment shown, for example, in FIG. 5). The adjustment is implemented through the tightening or loosening of excess strap material. Next, strap adjustment for the adjustable strap and buckle system 20 as shown in FIG. 2 is performed to complete the process for securing the harness piece 10 to the parent.

An adjustable, sliding back lateral strap 36 extends between the two adjustable shoulder straps 28*a* and 28*b* and prevents the adjustable shoulder straps 28*a* and 28*b* from falling off the shoulders of the parent.

The harness piece 10 further includes a first pair of adjustable baby support connection straps 40*a* and 40*b* which extend from the proximal ends of the two adjustable shoulder straps 28*a* and 28*b* near the connection with the top of the front panel portion 24. Each of these straps 40 includes a buckle connector 42 that is configured to connect to a certain location on the second, baby support, piece as will be described herein.

The second strap ends of the strap and buckle system 30 of the harness piece 10 further form a second pair of adjustable baby support connection straps 46*a* and 46*b* which each include a buckle connector 48 that is configured to connect to a certain location on the second, baby support piece as will be described herein.

Figure 6A:
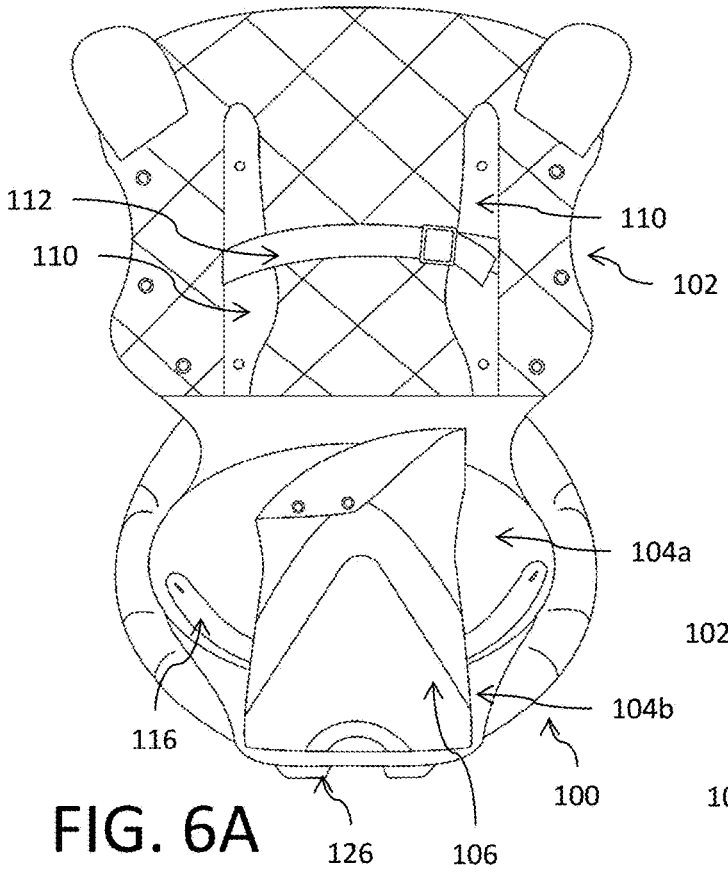
FIGS. 6A-6C and 7 show views of a baby support piece.
Figure 6B:
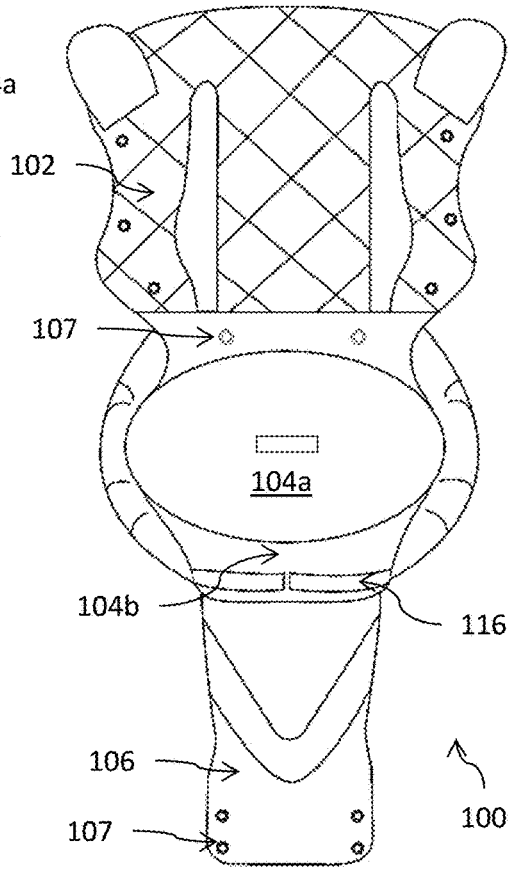
Figure 7:
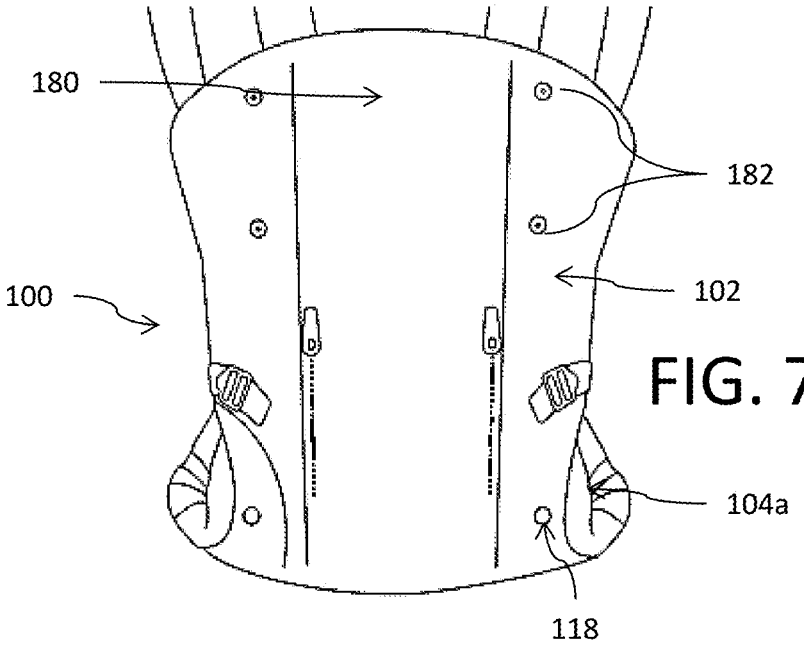

Reference is now made to FIGS. 6A and 6B and 7 which show opposite views of the second piece comprising a baby support piece 100 comprising an inside surface which is adjacent the baby and an outside surface, respectively. The inside surface advantageously is defined at least in part by a quilted fabric material that supports airflow and breathability; and it will be understood that further options beyond stitching for quilting of the fabric facing the baby may be used to promote air flow and breathability. For example, separation of foam pieces to form channels in the baby support piece 100 can be used. The baby support piece 100 defines a bucket seat that supports the weight of the baby and provides the baby with the proper, ergonomic seating position. The baby support piece 100 includes an upper portion 102 (preferably with the quilted fabric material inside surface and/or the use of foam channels), a seat portion 104*a*, a reinforced portion 104*b* for supporting connection to the harness piece 10, and a seat adjustment flap portion 106. The portions 102, 104*a*, 104*b* and 106 are sewn together; the stitched together structure functioning to define a proper ergonomic seating for the baby as well as support detachability of the baby support piece 100 from the harness piece 10. As will be discussed herein, in certain implementations the seat adjustment flap portion 106 is specifically used with portions 102, 104*a* and 104*b* to define the ergonomic seating position for a baby that is less than a certain weight threshold (for example, 9 lbs.). In other implementations, for a heavier, larger and/or older baby for example, the ergonomic seating position of the baby is supported primarily using the portions 102, 104*a* and 104*b* (with the flap 106 resting against the inside surface of the portions 104*a* and 104*b*).

Figure 6C:
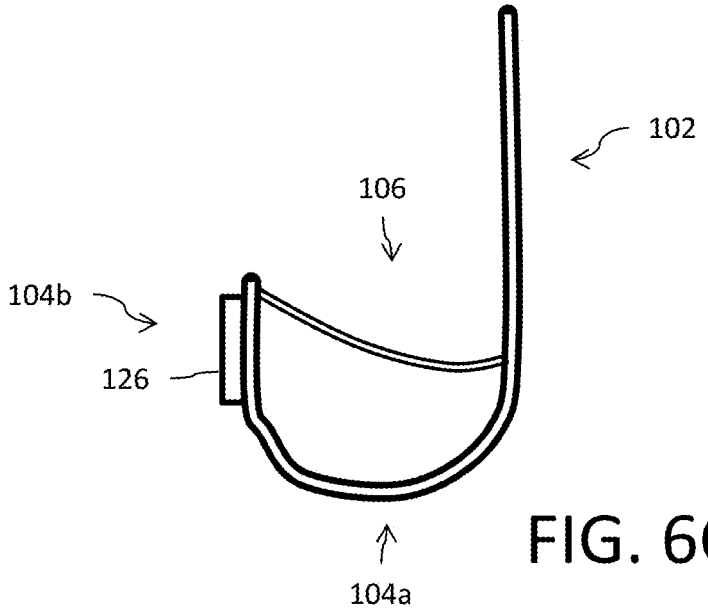

FIG. 6A shows the inside surface in a configuration folded position where the seat adjustment flap portion 106 is folded over the seat portion 104*a*, and FIG. 6B shows the inside surface in configuration unfolded position where the seat adjustment flap portion 106 extends from the reinforced portion 104*b*. FIG. 6C shows a schematic side view of the baby support piece 100 illustrating an implementation for the formation of the proper ergonomic seating space for supporting the baby whose weight is less than the threshold. A male connection part 126 is mounted on the outer surface of the portion 104*b* and configured for attachment to the female connection part 16 of the harness piece 10. In this configuration, the seat adjustment flap portion 106 extends over the seat portion 104*a* (for example, from the portion 104*b*) to a position attached to the upper portion 102 to provide for an adjustment in the baby seating height as will be described in more detail herein.

The upper portion 102 may be made of fabric covered foam. Additional padding and fabric quilting may be used on the inside surface of the upper portion 102. To assist with air flow and breathability, the foam may be arranged with channels as discussed above. The seat adjustment flap portion 106 may also be made of fabric covered foam, but a thickness of the foam material for the seat adjustment flap portion is thinner than a thickness for the upper portion. Alternatively, the portion 106 may be made of fabric (or other suitable support material) alone. The seat portion 104*a* is made of fabric and typically does not need or use foam. The reinforced portion 104*b* is made of a structurally reinforced material, such as an engineering plastic, with a foam and fabric covering. The male connection part 126 is mounted to and supported by the reinforced portion 104*b* at the outside surface. This male connection part 126 engages with the female connection part 16 so facilitate mounting of the baby support piece 100 to the harness piece 10. This is shown, for example, in FIG. 8C with the resulting attached baby support piece 100 and harness piece 10 shown in FIG. 8D. FIG. 8E shows a front view of the attached baby support piece 100 and harness piece 10 without the baby being present.

The configuration of the folded position of the seat adjustment flap portion 106 is used to adjust the seating position of the baby. See, FIG. 6C. Snap connectors 107 enable an adjustment in the positioning of the seat adjustment flap portion 106 in the folded position and are especially useful when the baby is small. When the snap connectors 107 are attached to the upper portion 102, the seat adjustment flap portion 106 forms a trapeze extending over the seat portion 104*a* that the bottom of the baby may rest on; this promotes a higher positioning of the baby within the baby support piece 100. As the baby grows, the snap connectors 107 are no longer attached and the seat adjustment flap portion 106 simply folds into a position adjacent the seat portion 104*a* as shown in FIG. 6A.

Figure 8A:
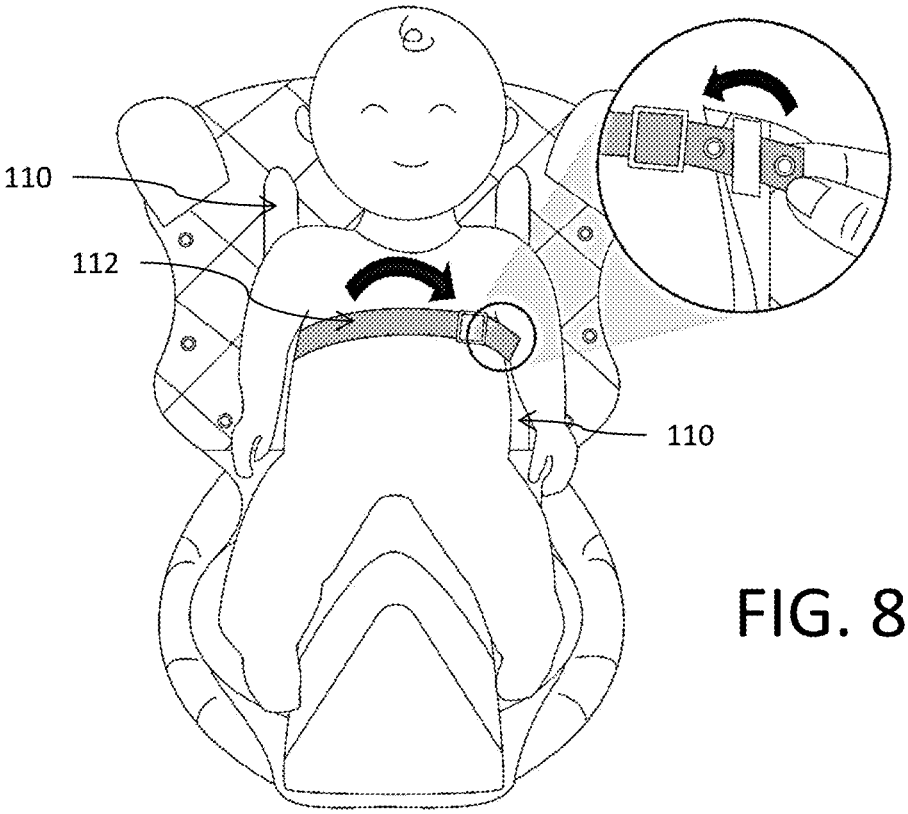
FIGS. 8A-8E show the securing of a baby within the baby support piece and the attachment of the baby support piece to the harness piece.
Figure 8B:
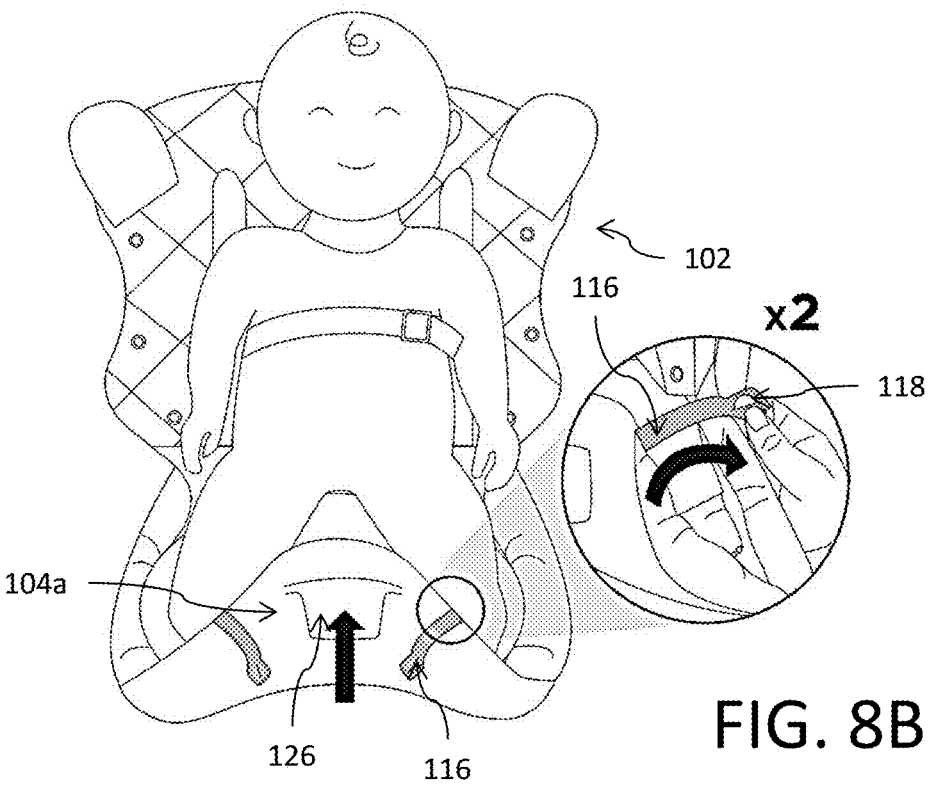

FIG. 8A shows the baby placed on the inside surface of the baby support piece 100 in connection with carrying in an inward facing front carry position. Here, the seat adjustment flap portion 106 may be attached through the snap connectors 107 to adjust the relative height position of the baby with respect to the upper portion 102. The upper portion 102 includes a pair of spaced-apart swaddle panels 110 and a swaddle strap 112; the swaddle panels 110 being stitched to the inside surface of the portion 102. The swaddle panels 110 can be raised on either side of the baby to support the sides of the body and head and the swaddle strap 112 extends across the chest of the baby with the ends of the swaddle strap connected to each swaddle panel. In this configuration, the legs of the baby extend adjacent the seat portion 104*a*. See, FIG. 8A. The reinforced portion 104*b* is then folded up around the legs of the baby as shown in FIG. 8B. For smaller babies, a pair of attachment straps 116 extend over the legs of the baby and attach to a post 118 on the outside surface of the baby support piece 100. For larger babies, the straps 116 need not be used.

The swaddle panels 110 contain receiving snaps on the underside of each panel which allow the panels to be securely fastened to the corresponding snaps on the inner part of the upper portion of the baby support piece. The swaddle panels are typically snapped down when no longer needed, usually when the baby has sufficient independent head and neck control. The swaddle strap 112 may be retained by the snap down of the swaddle panels and further secured by a snap to prevent the swaddle strap 112 from slipping out from underneath the secured swaddle panels.

Figure 8C:
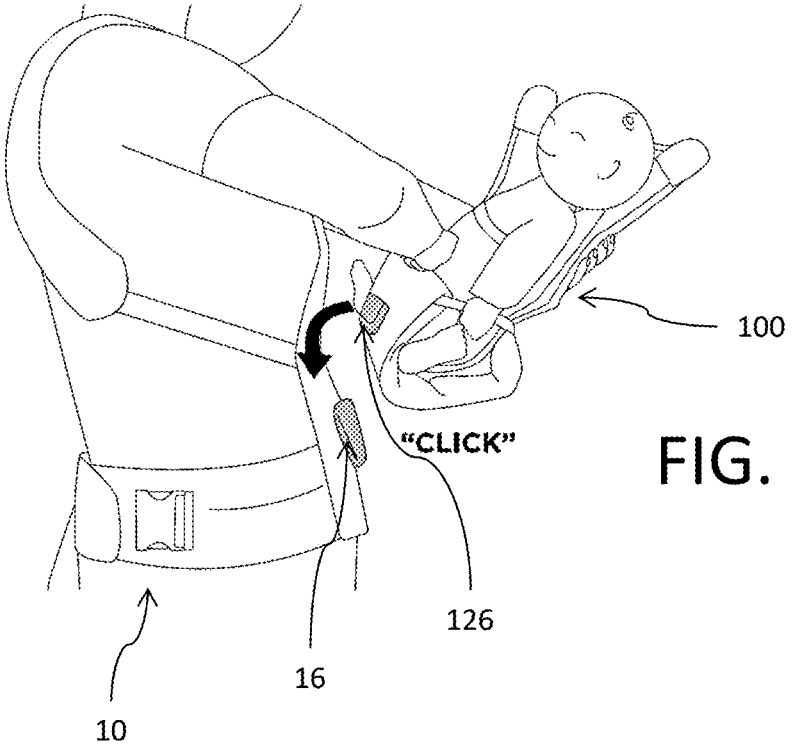
Figure 8D:
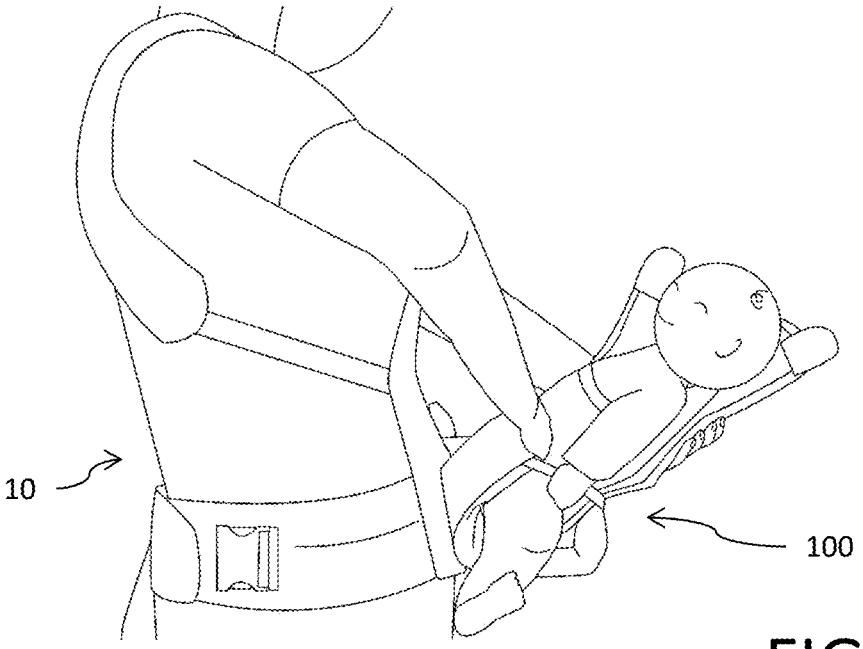
Figure 8E:
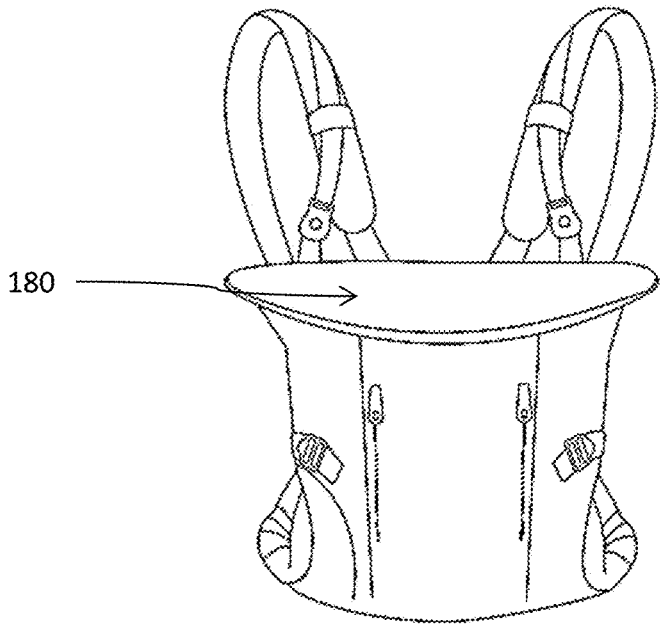
Figure 13A:
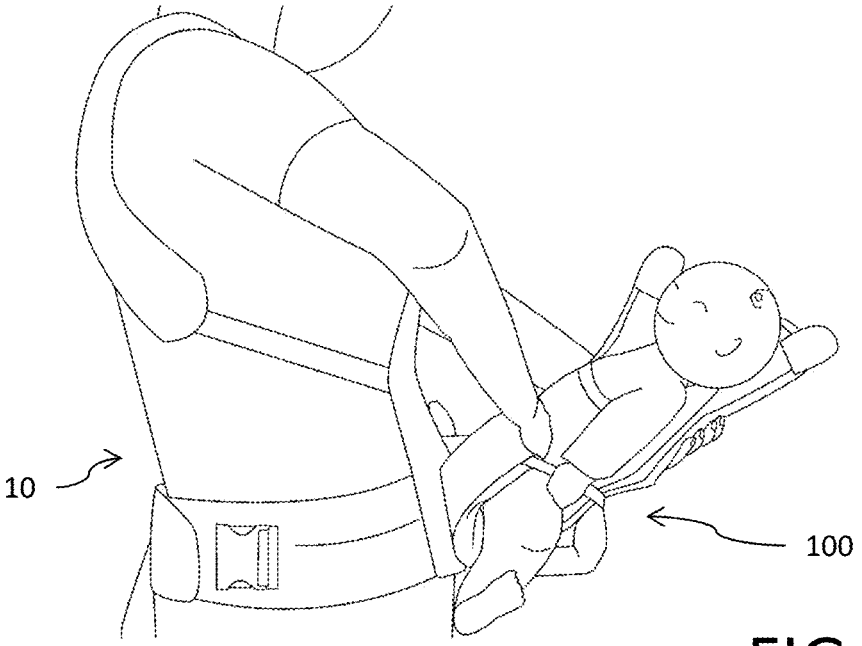
FIGS. 13A-13B show the process for disconnection of the baby support piece from the harness piece.
Figure 13B:
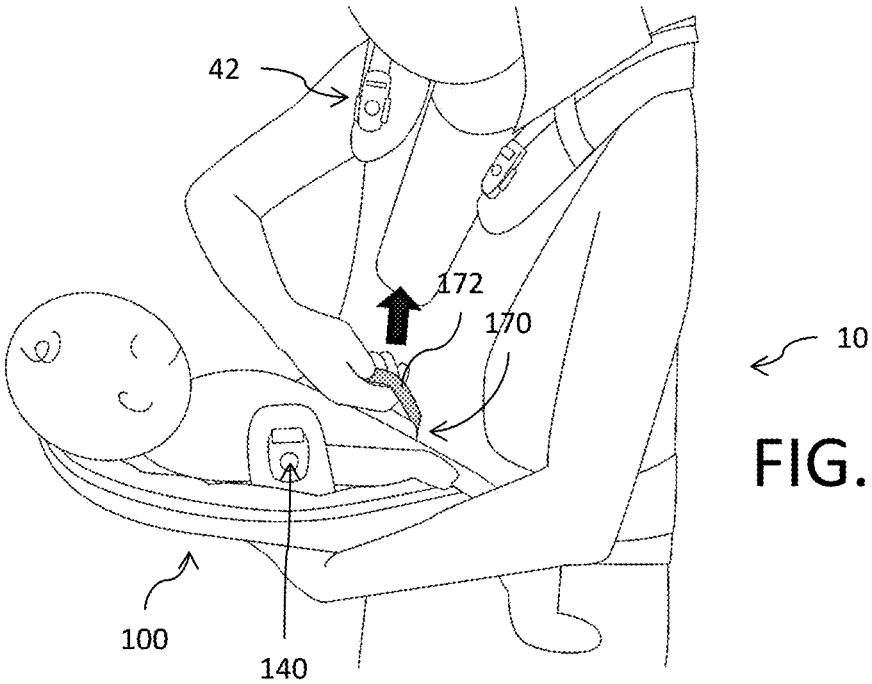

It will be noted, with reference to FIG. 8C and 8D that the parent may securely hold the baby support piece 100, with the secured baby, by placing one hand (for example the left hand as shown) under the outer surface of the upper portion 102 and grasping the reinforced portion 104*b* with the other hand (for example the right hand as shown). The grasping by the other hand may be made by grasping the reinforced portion 104*b* itself, as shown in FIGS. 8C and 8D, or by grasping the male connection part 126 as shown in FIG. 13B using a release ring (loop strap) 172 which is attached to the mechanism of the male connection part 126. The weight of the baby may be securely lifted or lowered while in the baby support piece 100.

Figure 9:
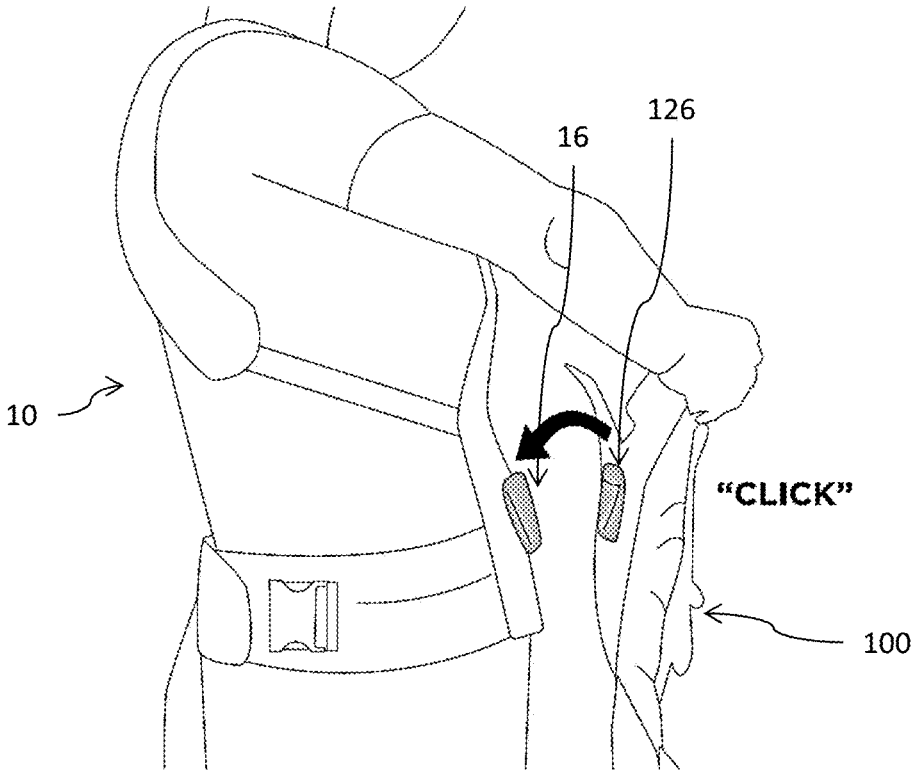
FIG. 9 shows the attachment of the baby support piece, without the baby being present, to the harness piece.
Figure 10A:
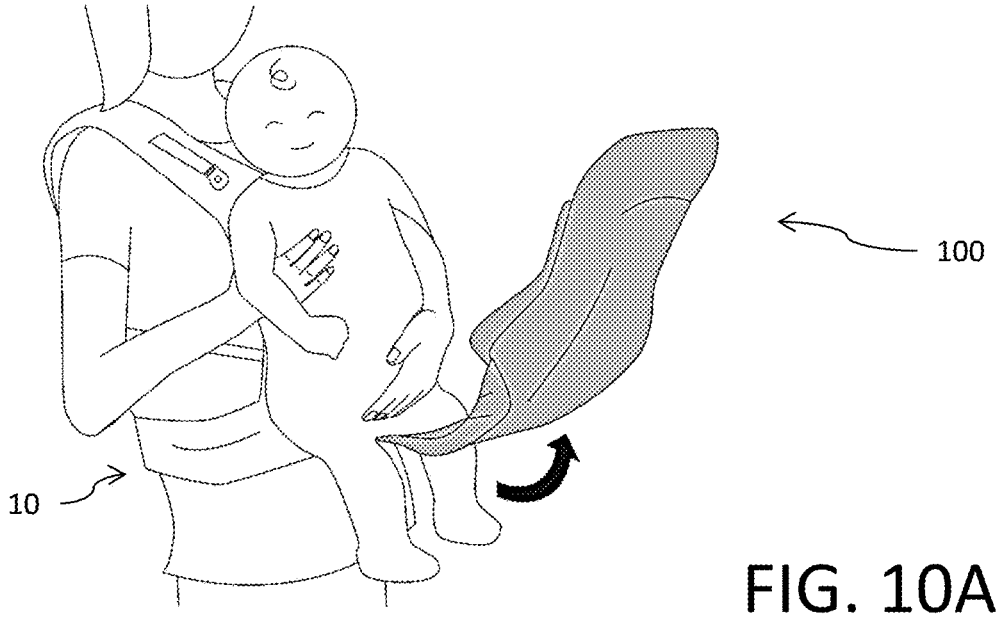
FIGS. 10A, 11A, 11C, 12A and 12C show the further securing of the baby in a forward facing front carry configuration.
Figure 10B:
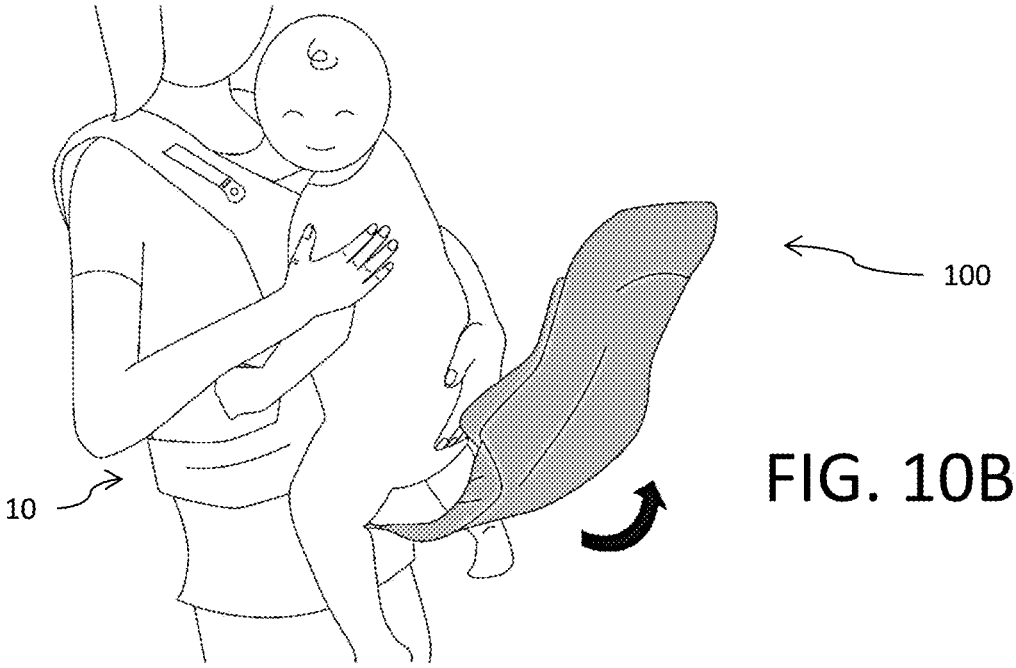
FIGS. 10B, 11B, 11D, 12B and 12D show the further securing of the baby in a rearward facing front carry configuration.
Figure 11A:
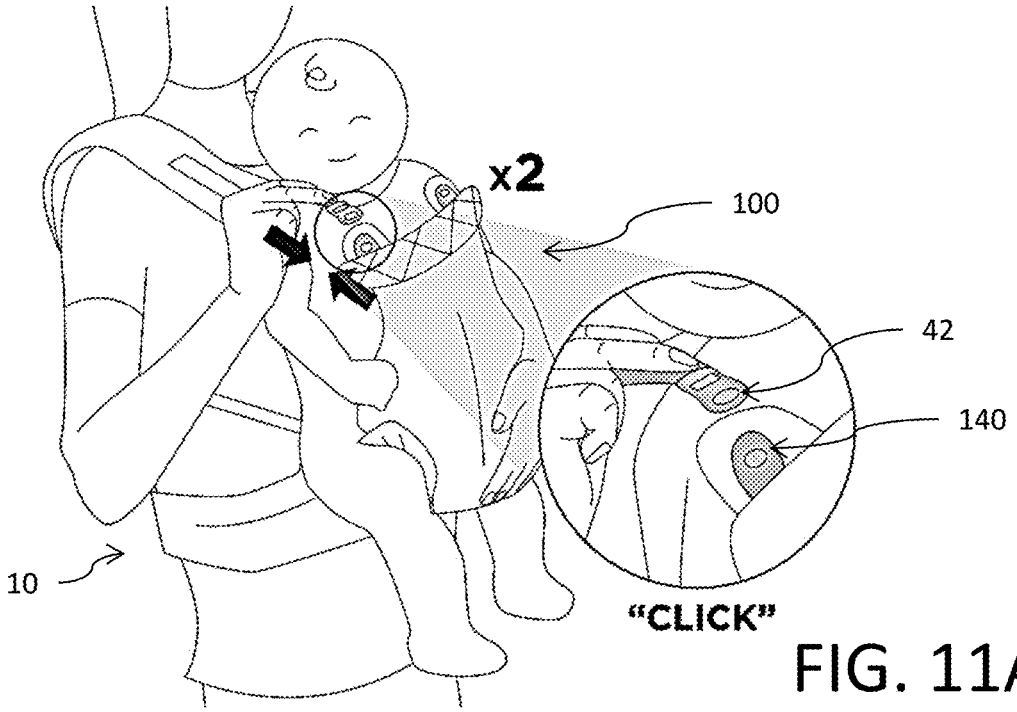
Figure 11B:
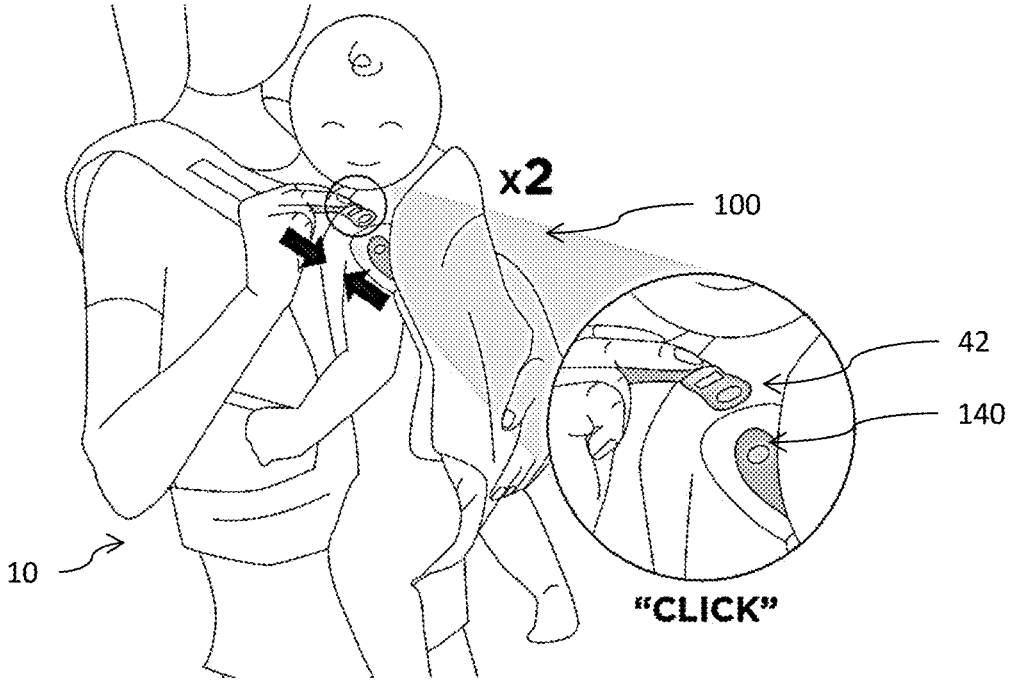
Figure 11C:
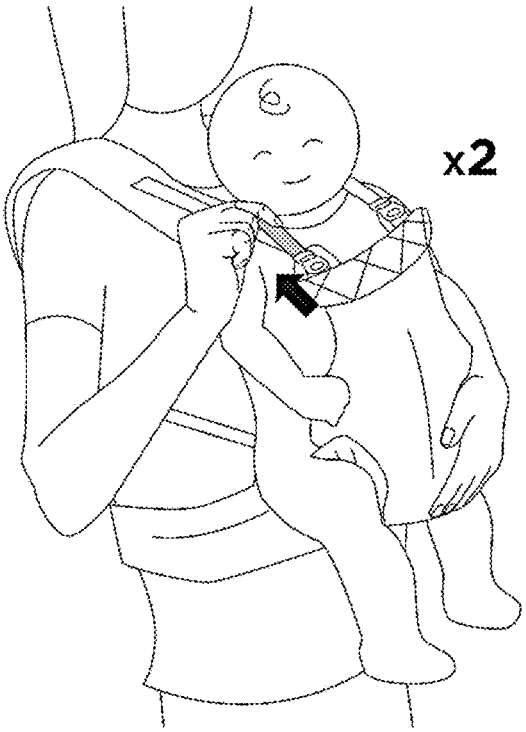
Figure 11D:
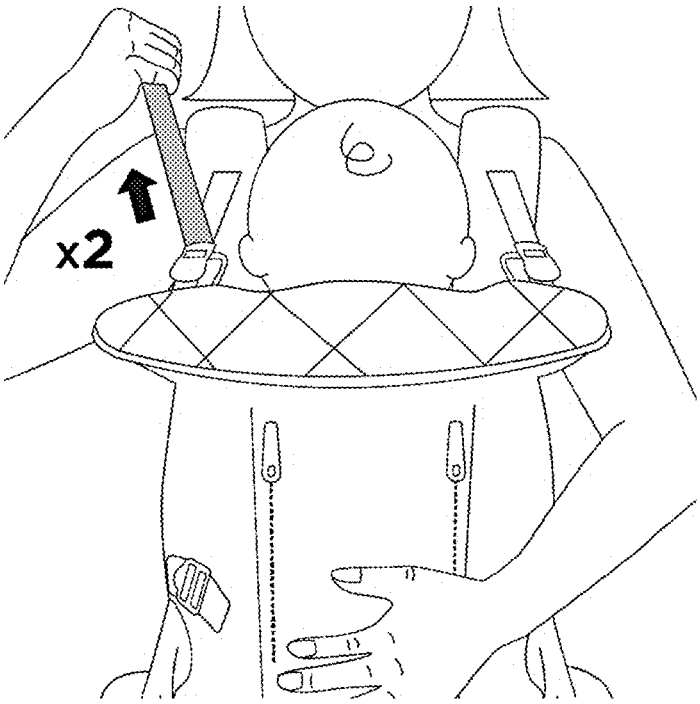

For a larger baby, the male connection part 126 may be engaged with the female connection part 16 before the baby support piece 100 is configured to support the baby. This is shown, for example in FIG. 9. After the connection between the baby support piece 100 and the harness piece 10 is made, the baby may be held by the parent, in either a forward facing position or rearward facing position as shown in FIGS. 10A and 10B, respectively, against the chest of the parent with the upper portion 102 and seat portion 104*a* of the baby support piece 100 passing between the legs of the baby. The seat portion 104*a* is positioned to support the crotch and/or bottom area of the baby and the upper portion 102 is positioned against the torso of the baby as shown in FIGS. 11A and 11B. The buckle connector 42 associated with each of the adjustable straps 40*a* and 40*b* (extending from the two adjustable shoulder straps 28*a* and 28*b*) engages a corresponding peg 140 at the upper portion 102 of the baby support piece 100. The adjustable straps 40*a* and 40*b* can be tightened to ensure that the baby is secure and safe as shown in FIGS. 11C and 11D.

The attachment as shown in FIG. 11B is equally applicable as well to the configuration of FIG. 8C.

Figure 12A:
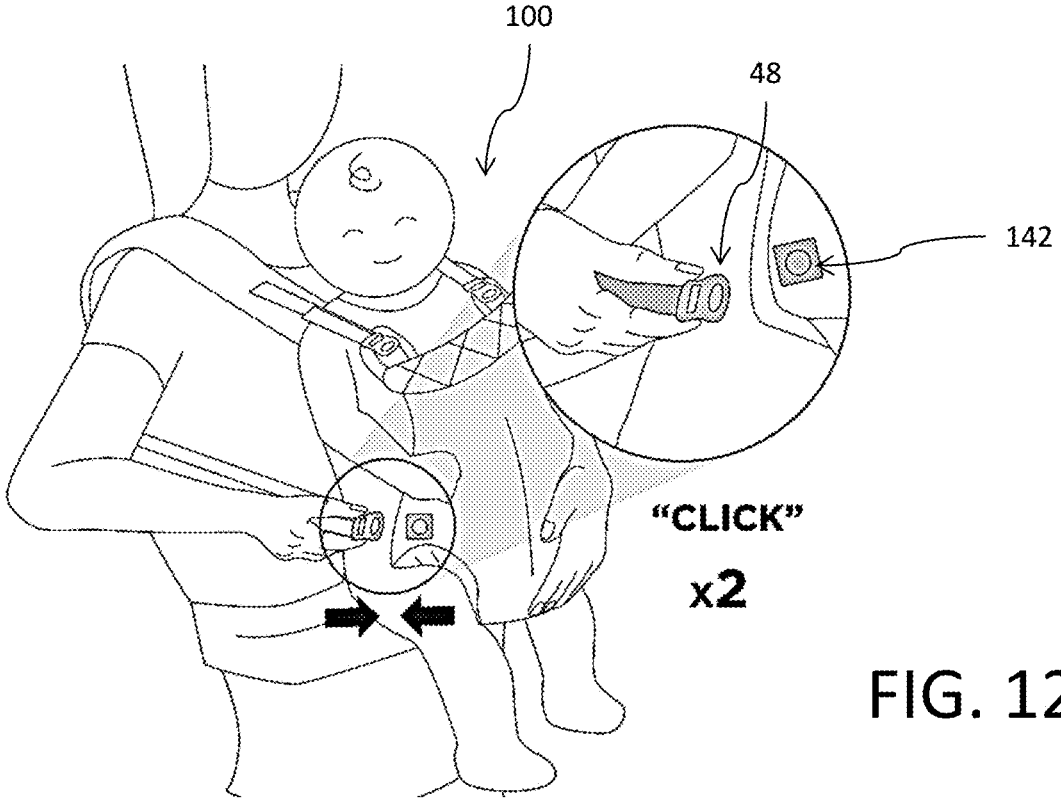
Figure 12B:
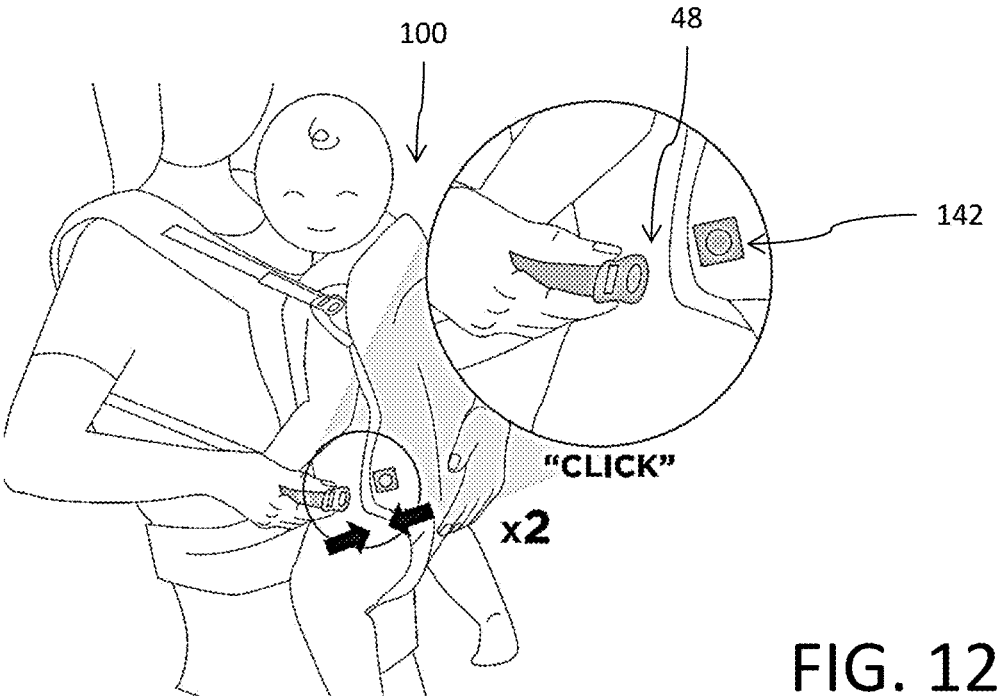
Figure 12C:
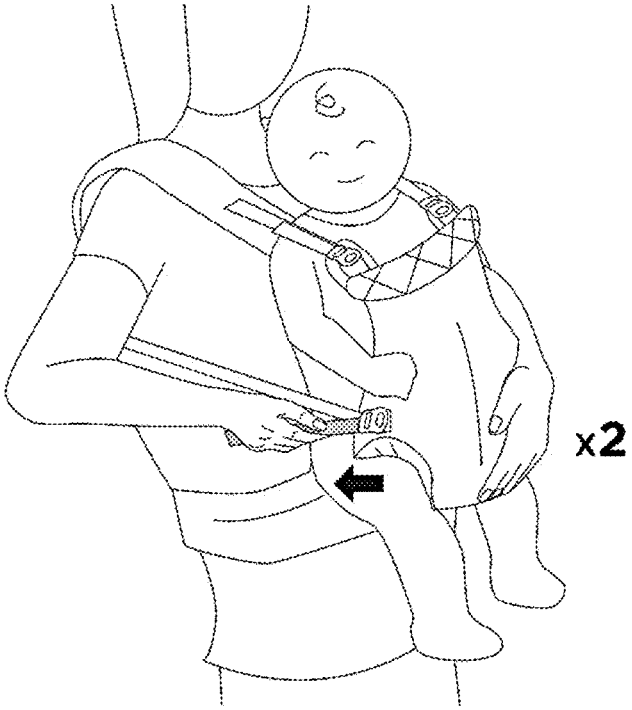
Figure 12D:
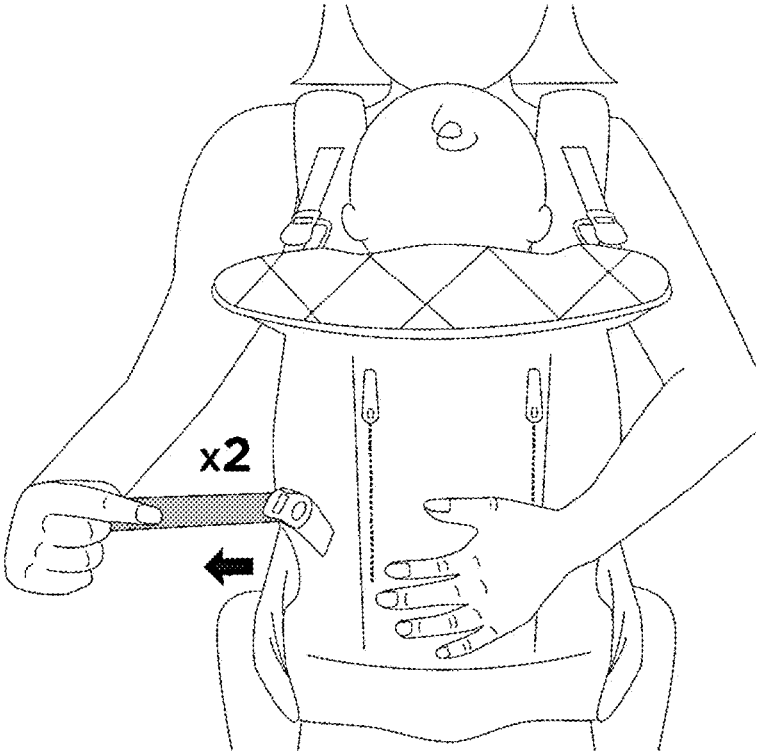

With reference to FIGS. 12A-12B, the buckle connector 48 associated with each of the adjustable straps 46*a* and 46*b* engages a corresponding peg 142 at the middle portion 104 of the baby support piece 100. The adjustable straps 46*a* and 46*b* can be tightened to ensure that the baby is secure and safe as shown in FIGS. 12C and 12D.

The attachment as shown in FIG. 12B is equally applicable as well to the configuration of FIG. 8C.

The engagement of the male connection part 126 with the female connection part 16 is a detachable engagement. To disconnect the baby support piece 100 from the harness piece 10, the buckle connectors 42 and 48 are disconnected. The baby support piece 100 may then be leaned away from the body of the parent as shown in FIG. 13A. This positioning gives the parent access to a release mechanism 170 associated with the male connection part 126. The release mechanism 170 includes the release ring 172 that the parent may grab and pull upwards as shown in FIG. 13B. This action causes the release of a latching restraint of the male connection part 126 which engages a component of the female connection part 16. As previously noted, the parent may use the release ring 172, in combination with other hand support on the outer surface of the portion 102, to securely manipulate the baby and the baby support piece 100 during both lifting (for example, dismounting of baby support piece 100 from the harness piece 10) and lowering (for example, mounting of the baby support piece 100 to the harness piece 10) operations. An advantage of this is that there is no need for the parent to reposition either hand, providing maximum leverage and safety, in connection with the engagement of the baby support piece 100 to or disengagement of the baby support piece 100 from the harness piece 10. The other hand of the parent further remains constantly in the proper position for supporting the back of the baby during this operation.

Figure 14A:
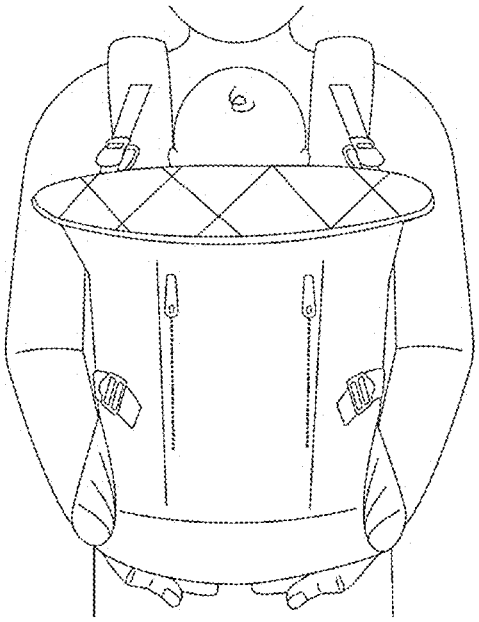
FIGS. 14A-14D illustrate a number of different supported carry positions.
Figure 14B:
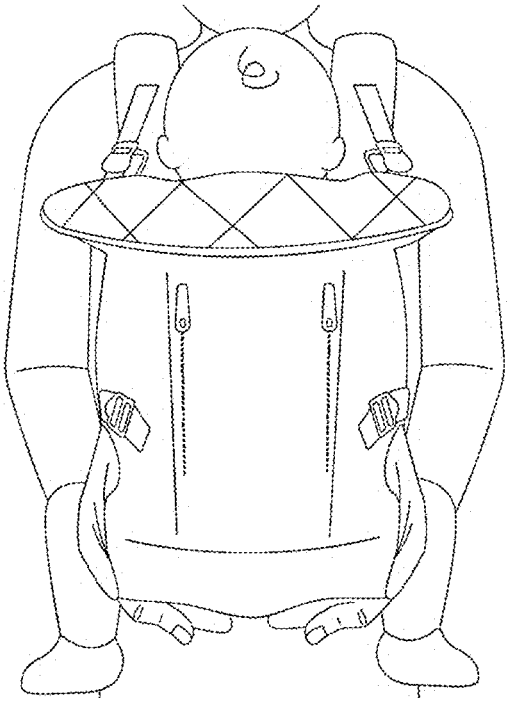
Figure 14C:
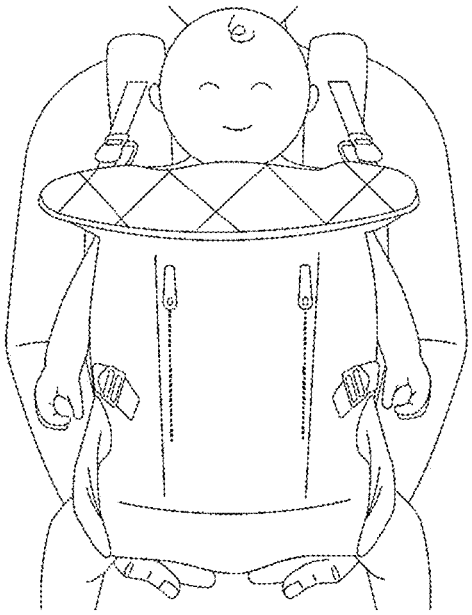
Figure 14D:
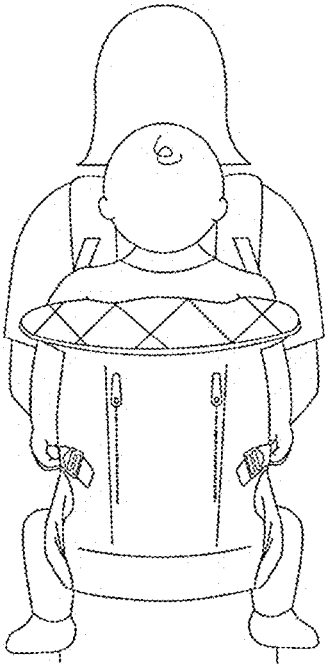

FIGS. 14A-14D illustrate various carrying positions supported by the baby carrier system. FIG. 14A shows an inward facing front carry of a baby who is an infant and requires use of the swaddle support as discussed herein. Additionally, in the configuration, the seat adjustment flap portion 106 may be engaged to provide the trapeze support extending over the seat portion 104*a* to promote a higher positioning of the baby within the baby support piece 100. FIG. 14B shows an inward facing front carry of a baby who is older. For this baby the swaddle support may be disengaged. Additionally, the seat adjustment flap portion 106 may be disengaged. FIG. 14C shows an outward facing front carry of a baby who is older. Again, because of the size of the baby, the seat adjustment flap portion 106 may be disengaged. FIG. 14D shows a back carry of a baby who is older.

Figure 15A:
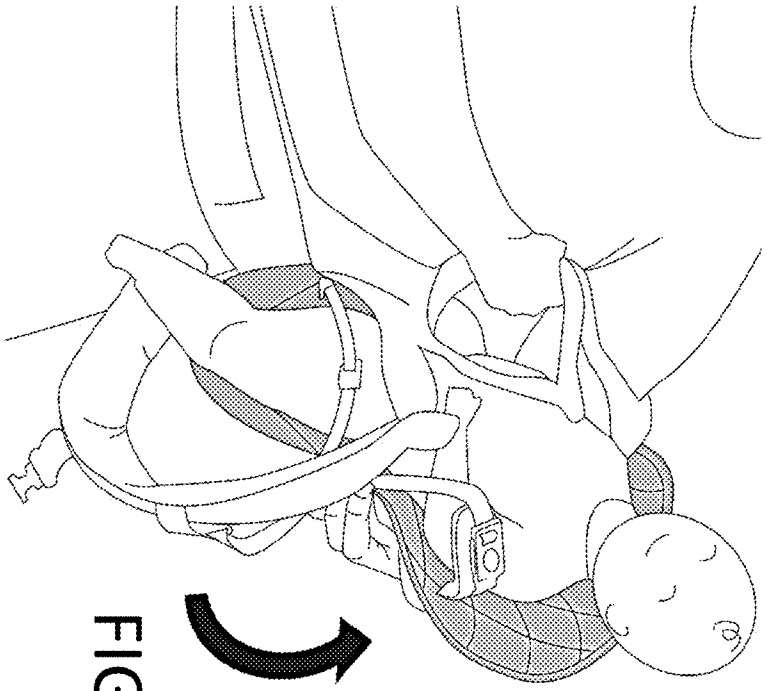
FIGS. 15A-15B illustrate the process for switching between front and back carry configurations.
Figure 15B:
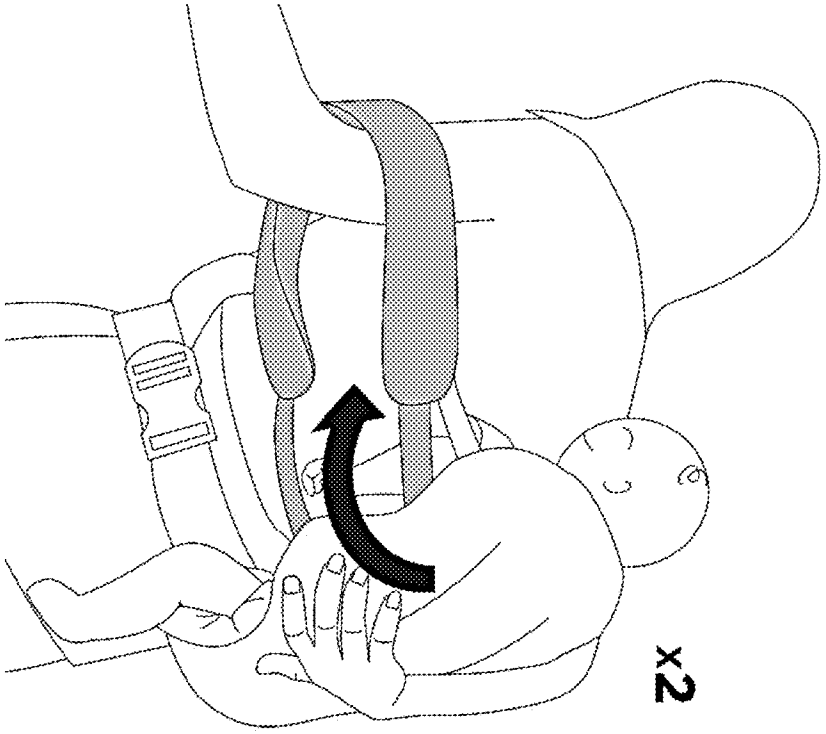

An advantage of the waist portion 12 and waist belt portions 18 along with the adjustable strap and buckle system 20 is that this assembly supports an easy reconfiguration of the baby carrier system between the front carry configuration and the back carry configuration. This is illustrated in FIGS. 15A-15B. The shoulder straps can be removed from the arms and shoulders of the parent while the waist portion 12 and waist belt portions 18 remain secured by the adjustable strap and buckle system 20 around the waist of the parent. In this operation the buckle connectors 42 and 48 remain connected so as to ensure a secure connection between the baby support piece 100 and the harness piece 10. The parent may then rotate the baby carrier system about the torso of the parent and re-engage the shoulder straps with the arms and shoulders of the parent.

A further advantage of the waist portion 12 and waist belt portions 18 along with the adjustable strap and buckle system 20 is that it presents a safer configuration than prior art baby carriers because the baby is fully secured (locked) into the carrier when rotating the child between front carry and back carry positions. With prior art baby carriers, the baby is typically not fitted into the carrier and is not restrained by any straps.

Reference is once again made to FIGS. 7 and 8E. The upper portion 102 of the baby support piece 100 includes a visibility/support flap portion 180 that may be folded down in certain carrying configurations. For a baby that is an infant, the visibility/support flap portion 180 remains in the upright, unfolded position to help support the head of the baby. As the baby grows older, however, the visibility/support flap portion 180 may be folded down and secured with snaps 182. This permits a higher degree of freedom of head movement for the baby and further facilitates the baby being able to see outward when in the forward facing front carry configuration.

Figure 16A:
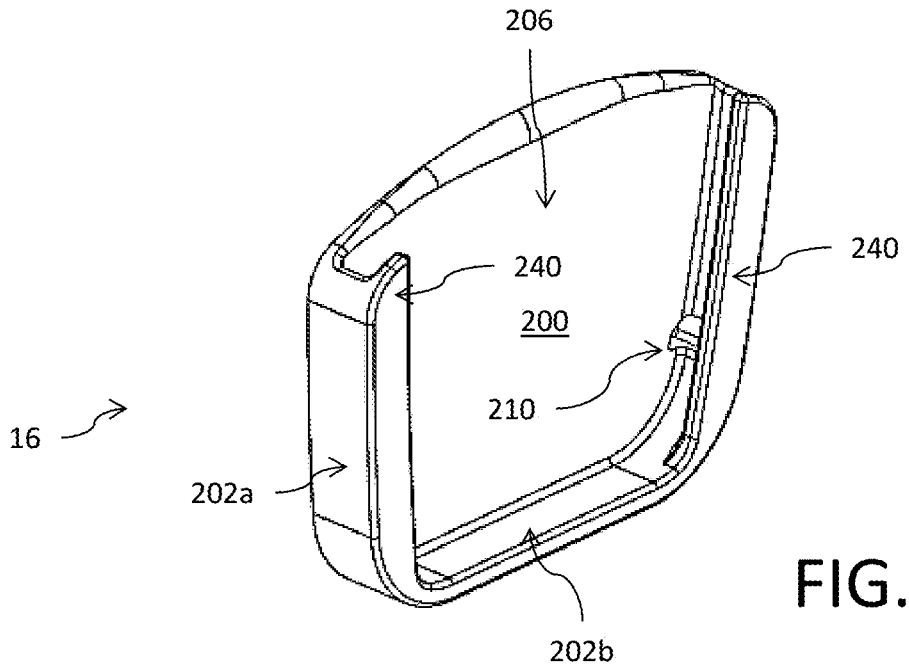
FIGS. 16A-16B show views of a female connector.
Figure 16B:
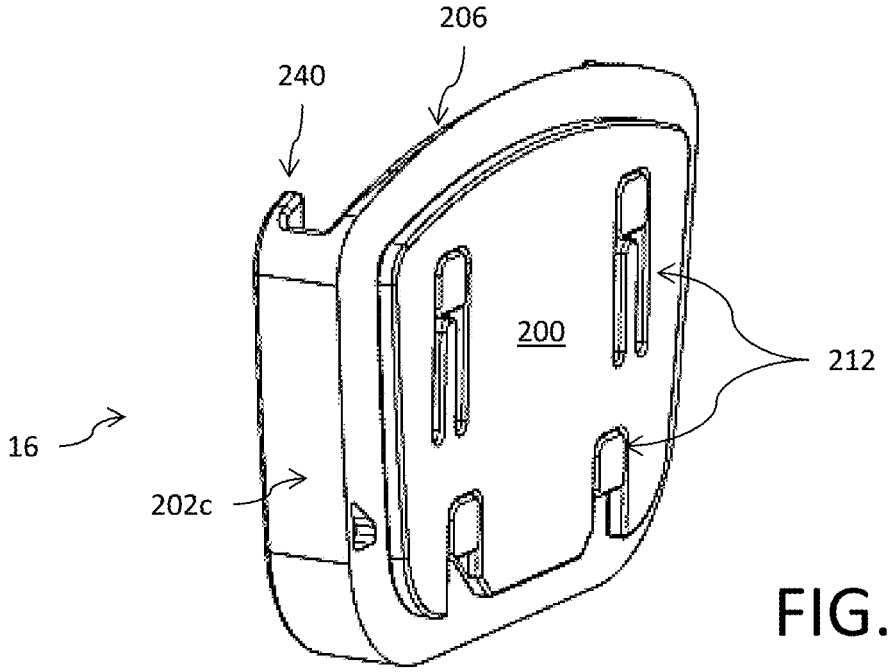

Reference is now made to FIG. 16A-16B which show front and rear perspective views, respectively, of the female connection part 16. The female connection part 16 includes a base portion 200 and sidewalls 202*a*, 202*b* and 202*c*. The base portion is generally rectangular in plan view and the sidewalls 202*a*, 202*b* and 202*c* extend along three consecutive adjacent edges. A fourth edge does not include a sidewall. The sidewalls 202*a*, 202*b* and 202*c* define a slot opening 206 configured to receive the male connection part 126 as will be explained and shown. A pair of tabs 210 (only one shown in FIG. 16A) project into the slot opening 206 from the inner walls of the sidewalls 202*a* and 202*c*. As will be discussed herein, the male connection part 126 includes retractable projections which engage the tabs 210 to facilitate securely connecting (latching) the male connection part 126 to the female connection part 16. The back side of the base portion 200 as shown in FIG. 16B includes structures 212 that are configured to support mounting of the female connection part 16 to the waist portion 12 of the harness piece 10.

Figure 17A:
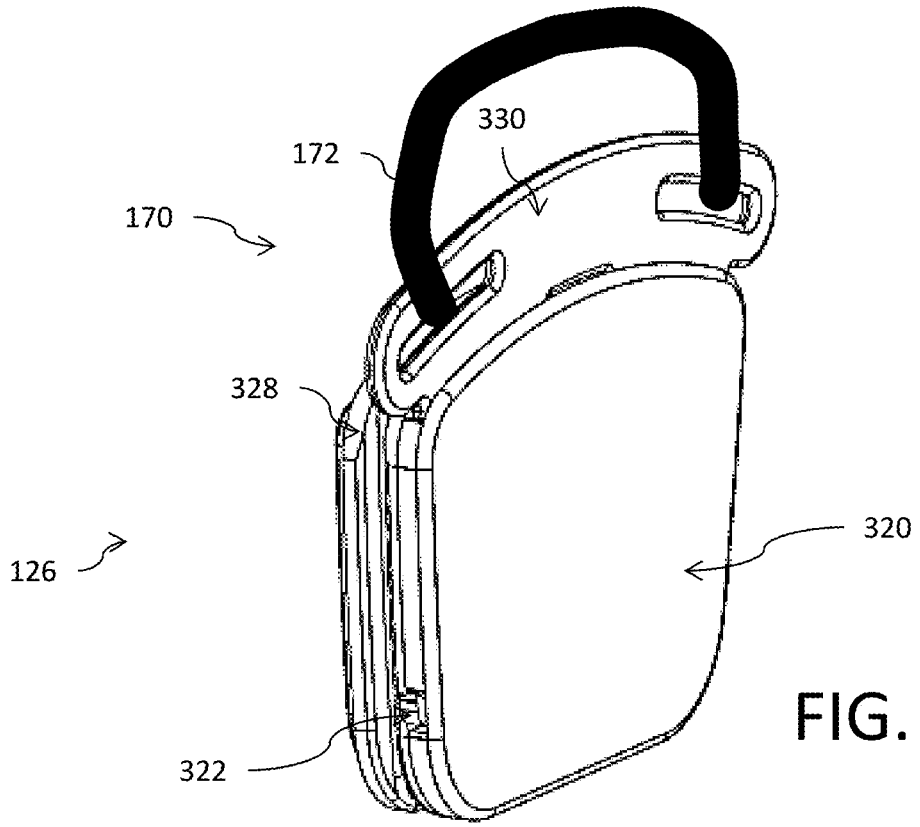
FIGS. 17A-17E show views of a male connector.
Figure 17B:
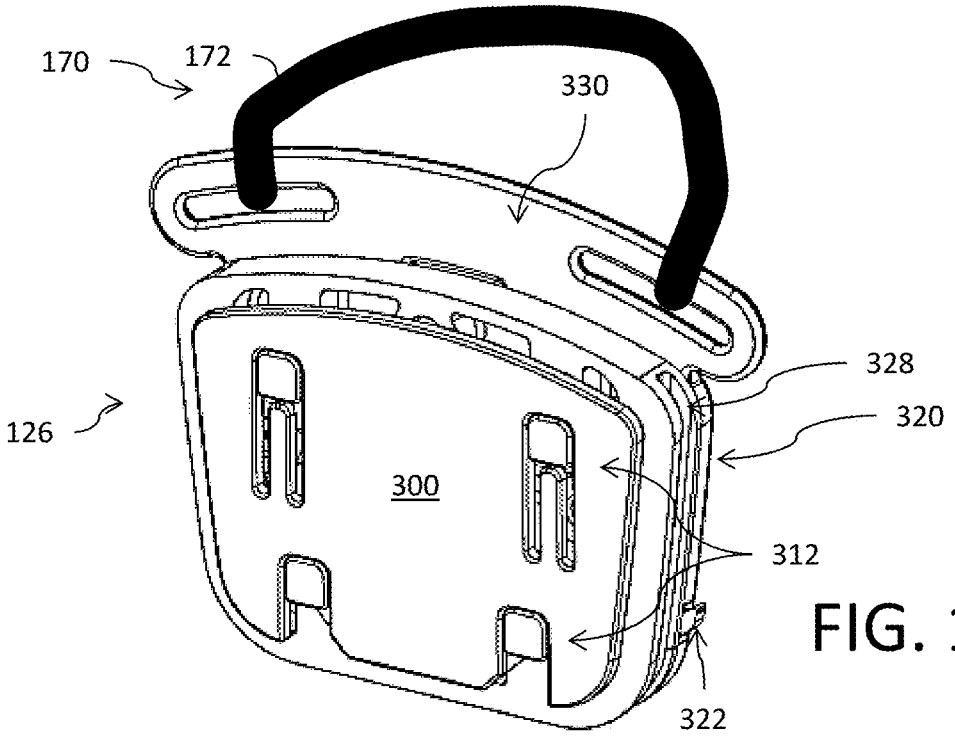

Reference is now made to FIG. 17A-17B which show front and rear perspective views, respectively, of the male connection part 126. The male connection part 126 includes a base portion 300. The back side of the base portion 300 as shown in FIG. 17B includes structures 312 that are configured to support mounting of the male connection part 126 to the bottom part of the reinforced portion 104*b* of the baby support piece 100. The base portion 300 is mounted to a body portion 320 which includes the release mechanism 170 for supporting operation of a plurality of retractable projections 322 which are configured to engage the tabs 210 within the slot opening 206 of the female connection part 16. A pull tab 330 supports actuation of the mechanism to cause a retraction of the retractable projections 322 when the pull tab 330 is pulled upward by the parent. The release ring 172 is secured to slots in the pull tab to support the release mechanism 170. The body portion 320 further includes a pair of slots 328 on opposite sides of the body portion. With reference once again to FIGS. 16A and 16B, the sidewalls 202*a* and 202*c* each include an inward projection 240 which engages with the slots 328 when the male connection part 126 is inserted into the female connection part 16.

Figure 17C:
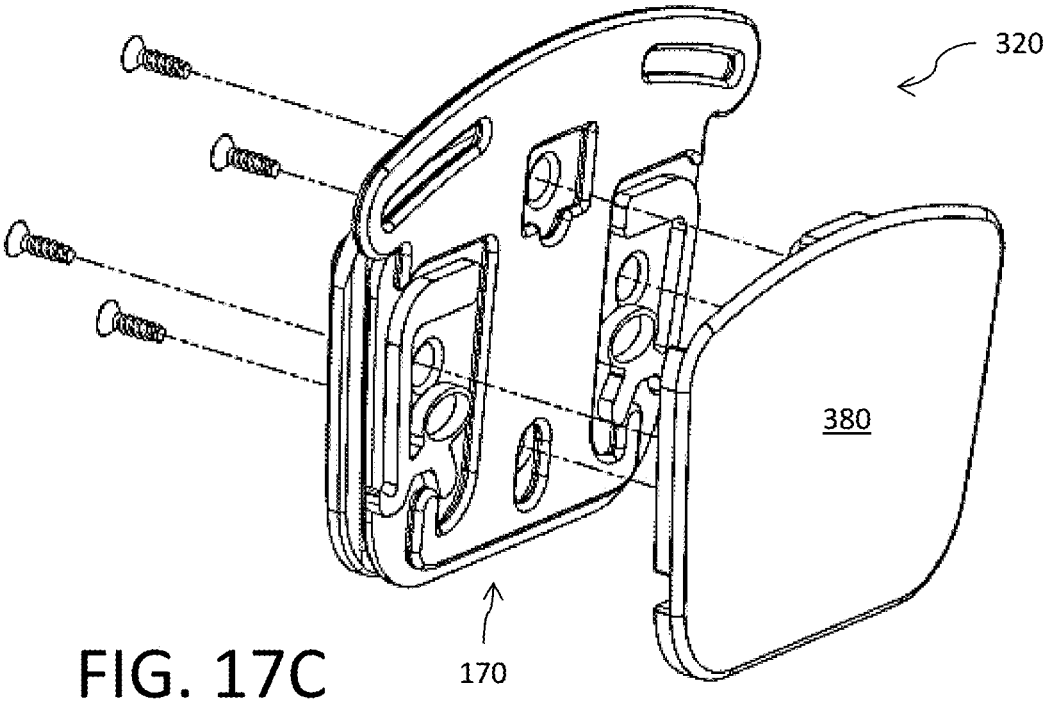
Figure 17D:
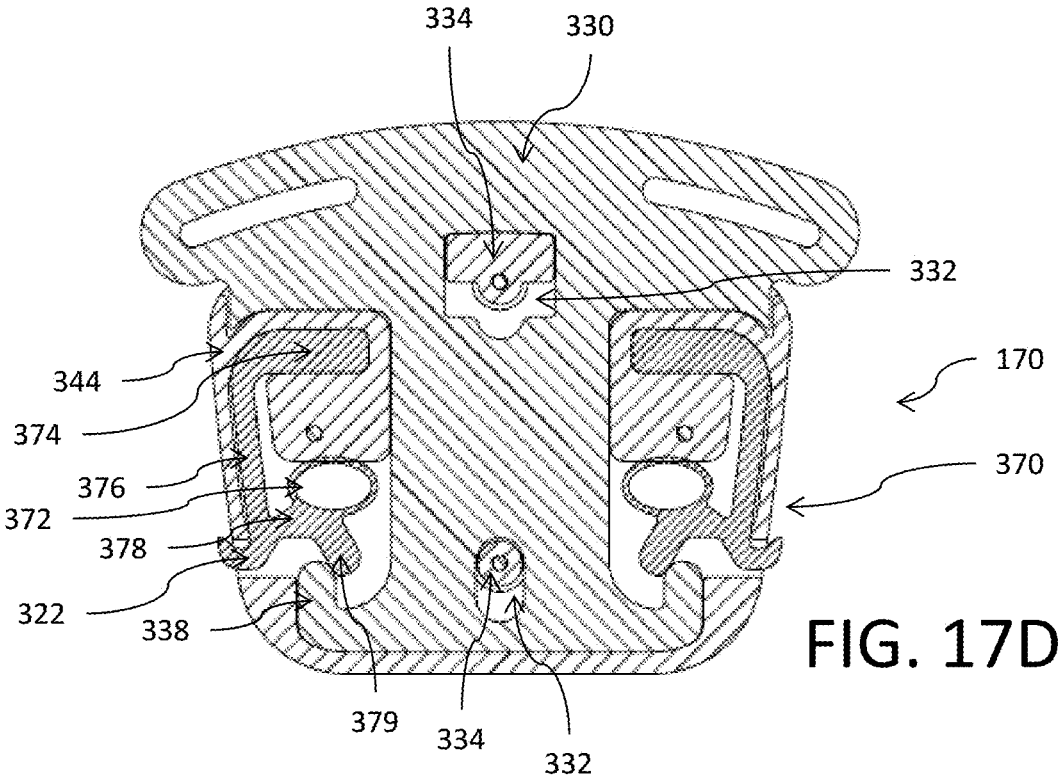

FIG. 17C shows that a cap 380 of the body portion 320 has been disassembled to expose the release mechanism 170 for supporting operation of a plurality of retractable projections 322. A cross sectional view through the mechanism is shown in FIG. 17D. The mechanism includes the pull tab 330. A pair of slots 332 in the pull tab 330 engage with projection structures 334 of a base 344 of the body portion 320. The slots are arranged and oriented to control movement of the pull tab 330 only in the longitudinal direction of the slots. The pull tab 330 further includes a pair of fingers 338 which engage a hook structure 370. The hook structure 370 includes a spring member 372, in this example having the shape of a resilient loop. The hook structure 370 further includes an anchor 374 which is retained by a portion of the base 344 of the body portion 320. An arm 376 extends from the anchor 374 to a core region 378. The spring member 372 is mounted to the core region 378. A pin 379 extends from the core region 378 and engages the finger 338 of the pull tab 330. When the pull tab 330 is actuated and longitudinally slides under the control of the slots 332 and projection structures 334, the finger 338 of the pull tab 330 pushes against the pin 379. The hook structure 370 responds to this force by having the arm 376 bend and the spring member 372 compress (in this context, it will be understood that the arm operates in the manner of a spring as well). The bending of the arm 376 shifts the position of the core region 378 and the projection 322 extending from the core region retracts toward the inside of the body portion 320. Once retracted, the projection 322 no longer engages the tabs 210 within the slot opening 206 and the male connection part 126 may be withdrawn from the female connection part 16.

With respect to insertion of the male connection part 126 into the female connection part 16, the projection 322 will contact the tabs 210 within the slot opening 206 as the male connection part 126 is inserted. The hook structure 370 responds to this force by having the arm 376 bend and the spring member 372 compress. This permits the projection 322 to pass by the tab 210. Once on the other side, the spring member 372 decompresses, the arm 376 unbends and the projection 322 engages the tab 210.

Figure 17E:
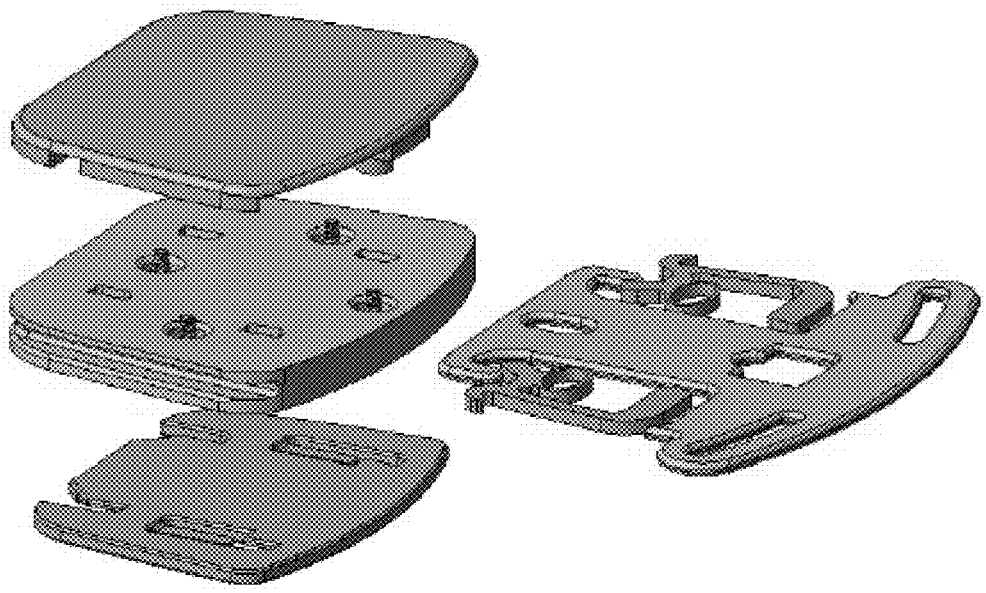

An exploded perspective view of the male connection part 126 is provided in FIG. 17E.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A baby carrier system, comprising:

a harness piece configured to be worn by a parent;

a baby support piece configured to support a baby;

wherein the harness piece includes a first connector of a male-female connector system and the baby support piece includes a second connector of the male-female connector system, wherein the first and second connectors engage with each other such that said male-female connector system permits the baby support piece to be mounted to the harness piece;

wherein the male-female connector system comprises:

a female connector element having a slot and a tab within the slot; and a male connector element comprising:

a body configured to be received within the slot, said body including:

a base, a first projection and a second projection extending within the body from said base and aligned with each other in a longitudinal direction, a retractable element mounted within the body and including a third projection extending outside the body and configured by a spring member to engage with said tab when in an extended position and disengage from said tab when in a retracted position, a pull member configured to engage the retractable element, the pull member including a first slot receiving the first projection and a second slot receiving the second projection, the first and second slots configured to permit sliding movement of the pull member along the longitudinal direction for moving the retractable element from the extended position to the retracted position, and a cover mounted to the base; and a ring mounted to a portion of the pull member extending outside the body and configured to be grabbed by a first arm of the parent to a) cause said sliding movement of the pull member to move the retractable element from the extended position to the retracted position and b) support the baby support piece during engagement and disengagement of the male connector from the female connector.

2. The baby carrier system of claim 1, wherein an outer surface of the baby support piece adjacent a back of the baby is configured to be engaged by a second arm of the parent to further support the baby support piece during engagement and disengagement of the male connector from the female connector.

3. The baby carrier system of claim 1, wherein the ring is configured to be held by a parent to support a weight of the baby when mounting and dismounting the baby support piece to and from the harness piece.

4. The baby carrier system of claim 1, wherein the slot of the female connector element is defined by a back and opposed side walls, said back configured to be mounted to one of the baby support piece or the harness piece.

5. The baby carrier system of claim 1, wherein the baby support piece is a fabric stitched piece including structure for promoting air flow and breathability comprising one or more of an inside surface that is at least partly formed by a quilted fabric layer and foam pieces defining channels.

6. The baby carrier system of claim 1, wherein the harness piece comprises:

a waist portion to which the first connector of the male-female connector system is mounted;

waist belt portions extending from the waist portion; and an adjustable strap and buckle system for connecting the waist belt portions.

7. The baby carrier system of claim 1, wherein the harness piece comprises:

a waist portion to which the first connector of the male-female connector system is mounted;

a front panel portion that is connected to the waist portion;

a pair of shoulder straps attached to a top of the front panel portion; and an adjustable strap and buckle system for connecting distal ends of the pair of shoulder straps to the front panel portion.

8. The baby carrier system of claim 7, wherein the adjustable strap and buckle system includes strap portions for connecting to the baby support piece.

9. The baby carrier system of claim 1, wherein the baby support piece comprises:

an upper portion;

a seat portion having a first side stitched to the upper portion;

a reinforced portion to which the second connector of the male-female connector system is mounted, wherein the reinforced portion is stitched to a second side of the seat portion; and a seat adjustment flap portion stitched to the reinforced portion;

wherein the stitching of the first and second sides of the seat portion to the upper portion and reinforced portion, respectively, defines an ergonomic seating for the baby.

10. The baby carrier system of claim 9, wherein an end of the seat adjustment flap portion is selectively attachable to the upper portion in a way that extends the seat adjustment flap portion over the seat portion so as to support positioning of the baby at a higher height within the baby support piece.

11. The baby carrier system of claim 9, wherein the baby support piece further comprises a pair of swaddle panels extending from the inside surface of the upper portion, said swaddle panels positioned to support sides and a head of the baby.

12. The baby carrier system of claim 1, wherein the harness piece comprises:

a pair of shoulder straps; and an adjustable strap and buckle system for securing the pair of shoulder straps;

wherein the baby support piece comprises:

an upper portion; and a reinforced portion to which the second connector of the male-female connector system is mounted;

wherein the adjustable strap and buckle system includes extensions with buckles configured for attachment to the upper portion of the baby support piece.

13. The baby carrier system of claim 12, wherein the harness piece further comprises a further adjustable strap and buckle system extending from the pair of shoulder straps and configured for attachment to the upper portion of the baby support piece.

14. The baby carrier system of claim 1, wherein the baby support piece comprises:

an upper portion;

a seat portion within which the baby is seated; and a reinforced portion to which the second connector of the male-female connector system is mounted;

wherein the harness piece comprises:

a pair of shoulder straps; and an adjustable strap and buckle system extending from the pair of shoulder straps and configured for attachment to the upper portion of the baby support piece.

15. A baby carrier system, comprising:

a harness piece configured to be worn by a parent;

a baby support piece configured to support a baby;

wherein the harness piece includes a first connector of a male-female connector system and the baby support piece includes a second connector of the male-female connector system, wherein the first and second connectors engage with each other such that said male-female connector system permits the baby support piece to be mounted to the harness piece;

wherein the harness piece further comprises:

a waist portion to which the first connector is mounted;

a pair of waist belt portions extending from the waist portion;

a first adjustable strap and buckle system including a first strap extending from one waist belt portion and a first buckle for connecting to the other waist belt portion, wherein the first strap is adjustably positioned through the first buckle;

a front panel portion having a bottom connected to the waist portion;

a pair of shoulder straps attached to a top of the front panel portion at a proximal end of each shoulder strap;

a second adjustable strap and buckle system including a second strap extending from the proximal end of each shoulder strap and having a second buckle configured for attachment to an upper portion of the baby support piece, wherein the second strap is adjustably positioned through the second buckle; and a third adjustable strap and buckle system including a third strap extending from a distal end of each shoulder strap and having a third buckle configured for attachment to a side of the front panel portion and a fourth buckle configured for attachment to a side portion of the baby support piece for connecting the waist portion, wherein the third strap is adjustably positioned through both the third and fourth buckles; and said second connector including a ring that is configured to be grabbed by a first arm of the parent to support the baby support piece during engagement and disengagement of the male connector from the female connector.

16. The baby carrier system of claim 15, wherein the male-female connector system comprises:

a female connector element having a slot and a tab within the slot; and a male connector element comprising:

a body configured to be received within the slot, said body including:

a base, a first projection and a second projection extending within the body from said base and aligned with each other in a longitudinal direction, a retractable element mounted within the body and including a third projection extending outside the body and configured by a spring member to engage with said tab when in an extended position and disengage from said tab when in a retracted position, a pull member configured to engage the retractable element, the pull member including a first slot receiving the first projection and a second slot receiving the second projection, the first and second slots configured to permit sliding movement of the pull member along the longitudinal direction for moving the retractable element from the extended position to the retracted position, and a cover mounted to the base.

17. The baby carrier system of claim 16, wherein the slot of the female connector element is defined by a back and opposed side walls, said back configured to be mounted to one of the baby support piece or the harness piece.

18. The baby carrier system of claim 17, wherein the ring is mounted to a portion of the pull member extending outside the body and configured to be grabbed by a first arm of the parent to cause said sliding movement of the pull member to move the retractable element from the extended position to the retracted position.

19. The baby carrier system of claim 15, wherein an outer surface of the baby support piece adjacent a back of the baby is configured to be engaged by a second arm of the parent to further support the baby support piece during engagement and disengagement of the male connector from the female connector.

20. The baby carrier system of claim 15, wherein the ring is configured to be held by a parent to support a weight of the baby when mounting and dismounting the baby support piece to and from the harness piece.

21. The baby carrier system of claim 15, wherein the baby support piece is a fabric stitched piece including structure for promoting air flow and breathability comprising one or more of an inside surface that is at least partly formed by a quilted fabric layer and foam pieces defining channels.

22. The baby carrier system of claim 15, wherein the baby support piece comprises:

an upper portion;

a seat portion having a first side stitched to the upper portion;

a reinforced portion to which the second connector of the male-female connector system is mounted, wherein the reinforced portion is stitched to a second side of the seat portion; and a seat adjustment flap portion stitched to the reinforced portion;

wherein the stitching of the first and second sides of the seat portion to the upper portion and reinforced portion, respectively, defining an ergonomic seating for the baby.

23. The baby carrier system of claim 22, wherein an end of the seat adjustment flap portion is selectively attachable to the upper portion in a way that extends the seat adjustment flap portion over the seat portion so as to support positioning of the baby at a higher height within the baby support piece.

24. The baby carrier system of claim 22, wherein the baby support piece further comprises a pair of swaddle panels extending from the inside surface of the upper portion, said swaddle panels positioned to support sides and a head of the baby.

25. The baby carrier system of claim 15, wherein the third adjustable strap and buckle system further includes a fifth buckle at the distal end of each shoulder strap, wherein the third strap is adjustably positioned through the fifth buckle.

26. The baby carrier system of claim 15, wherein the third strap adjustably passes through the third buckle to support adjustment of a harness piece arm opening for the parent and further passes adjustably through the fourth buckle to support adjustment of position for the baby support piece.

* * * * *